US012514347B1

(12) United States Patent
Zhang et al.

(10) Patent No.: US 12,514,347 B1
(45) Date of Patent: Jan. 6, 2026

(54) CANE WITH SEAT

(71) Applicant: Horizon (Shenzhen) Health Technology Co., Ltd., Shenzhen (CN)

(72) Inventors: Huaxing Zhang, Jiangxi (CN); Shouwen Meng, Jiangxi (CN); Zuohua Liao, Guangdong (CN); Xian'e Zhu, Jiangxi (CN); Zhuyun Dong, Guangdong (CN)

(73) Assignee: Horizon (Shenzhen) Health Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/063,774

(22) Filed: Feb. 26, 2025

(30) Foreign Application Priority Data

| | | |
|---|---|---|
| Jan. 22, 2025 | (CN) | 202510112193.8 |
| Jan. 22, 2025 | (CN) | 202520157181.2 |
| Jan. 22, 2025 | (CN) | 202520157191.6 |
| Jan. 22, 2025 | (CN) | 202520158056.3 |
| Jan. 22, 2025 | (CN) | 202520162717.X |

(51) Int. Cl.
*A45B 5/00* (2006.01)
*A45B 1/04* (2006.01)
*A45B 9/02* (2006.01)

(52) U.S. Cl.
CPC ..... *A45B 5/00* (2013.01); *A45B 1/04* (2013.01); *A45B 9/02* (2013.01)

(58) Field of Classification Search
CPC ..... A45B 5/00
See application file for complete search history.

(56) References Cited

U.S. PATENT DOCUMENTS

| | | | | |
|---|---|---|---|---|
| 9,357,820 | B2 * | 6/2016 | Pao | A45B 5/00 |
| 9,504,297 | B2 * | 11/2016 | Pao | A47C 4/04 |
| 10,064,462 | B2 * | 9/2018 | Pao | A45B 5/00 |
| 11,432,651 | B2 * | 9/2022 | Pao | A45B 5/00 |
| 11,700,946 | B2 * | 7/2023 | Pao | A47C 9/105 297/16.2 |
| 2014/0034097 | A1 * | 2/2014 | Pao | A45B 5/00 135/66 |
| 2014/0034098 | A1 * | 2/2014 | Pao | A45B 5/00 135/66 |
| 2015/0107636 | A1 * | 4/2015 | Pao | A45B 5/00 135/66 |
| 2024/0008605 | A1 * | 1/2024 | Pao | A45B 5/00 |
| 2024/0008606 | A1 * | 1/2024 | Pao | A47C 9/10 |
| 2024/0041217 | A1 * | 2/2024 | Pao | A47C 9/105 |

* cited by examiner

*Primary Examiner* — Noah Chandler Hawk
(74) *Attorney, Agent, or Firm* — JEEN IP LAW, LLC

(57) ABSTRACT

A cane with a seat includes a support assembly and a seat assembly, where the support assembly includes a support base, a slider, a main rod, and two auxiliary rods; the main rod and the auxiliary rod penetrate through the support base and are rotatably connected to the support base; two opposite ends of each of the main rod and the auxiliary rod are stretched out of the support base; the slider is in sliding fit with the main rod and is configured to drive the support assembly to switch between a collapsed state and an expanded state; the seat assembly includes a main seat surface and two auxiliary seat surfaces; the two auxiliary seat surfaces are rotatably connected to two opposite sides of the main seat surface in one-to-one correspondence; the main seat surface is rotatably connected to the slider.

18 Claims, 21 Drawing Sheets

CANE WITH SEAT

TECHNICAL FIELD

The present disclosure relates to the technical field of articles for daily use, in particular to a cane with a seat.

BACKGROUND

As an article of the elderly for daily use, the cane with a seat usually has a collapsed state and an expanded state. In the collapsed state, it can serve as a cane with a seat for supporting. In the expanded state, the elderly can sit down on the cane with a seat for resting.

According to the related art, such as the patent CN 114903262 B, the cane with a seat is supported by a locating member and two support rods. The locating member and the two support rods penetrate through a support base. In the expanded state, the two support rods have different angles of deflection relative to the main rod to suffer different forces. This is prone to unstable supporting.

SUMMARY

An embodiment of the present disclosure provides a cane with a seat, to improve the supporting stability of the cane with a seat in the expanded state.

A cane with a seat includes:

a support assembly including a support base, a slider, a main rod, and two auxiliary rods, where the main rod and the auxiliary rod penetrate through the support base and are rotatably connected to the support base; two opposite ends of each of the main rod and the auxiliary rod are stretched out of the support base; the slider is in sliding fit with the main rod and is configured to drive the support assembly to switch between a collapsed state and an expanded state; in the collapsed state, the two auxiliary rods are collapsed to the main rod; and in the expanded state, the two auxiliary rods form an included angle with the main rod and are symmetrically located at two opposite sides of the main rod; and a seat assembly including a main seat surface and two auxiliary seat surfaces, where the two auxiliary seat surfaces are rotatably connected to two opposite sides of the main seat surface in one-to-one correspondence; the main seat surface is rotatably connected to the slider; and when the support assembly is switched from the collapsed state to the expanded state, the slider drives the main seat surface to expand, the main seat surface drives the auxiliary seat surface to expand, and ends of the two auxiliary rods close to the seat assembly support the two auxiliary seat surfaces in one-to-one correspondence.

BRIEF DESCRIPTION OF THE DRAWINGS

To describe the technical solutions in the embodiments of the present disclosure or in the prior art more clearly, the following briefly describes the accompanying drawings required for describing the embodiments or the prior art. Apparently, the accompanying drawings in the following description show merely some embodiments of the present disclosure, and a person of ordinary skill in the art may still derive other drawings from these accompanying drawings without creative efforts.

REFERENCE NUMERALS

Figure 1:
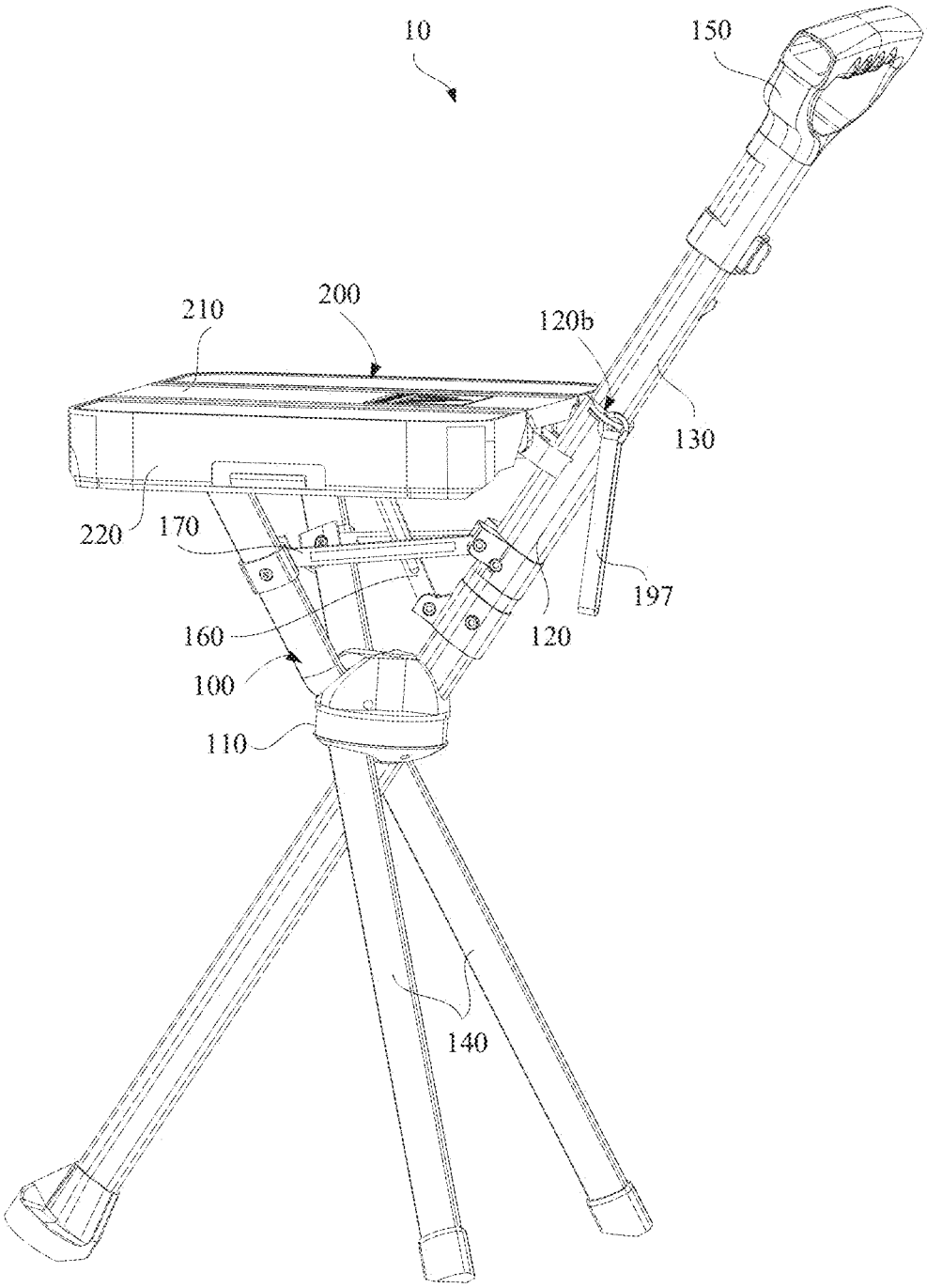
FIG. 1 is a schematic view of a cane with a seat in an expanded state according to an embodiment.

10: cane with a seat, 100: support assembly, 110: support base, 111: main body, 111*a*: through hole, 111*b*: groove, 111*c*: shaft hole, 113: cover plate, 115: clamping ring, 116: rotating shaft, 120: slider, 120*a*: second clamping hole, 120*b*: hanging hole, 121: protrusion, 123: sleeve, 125: connecting pin, 130: main rod, 130*a*: through groove, 130*b*: first clamping hole, 130*c*: first adjusting hole, 135: limiting sleeve, 140: auxiliary rod, 140*a*: gap, 140*b*: upper included-angle space, 140*c*: lower included-angle space, 141: pin shaft, 143: torsional spring, 145: support end, 150: handle, 151: gripping portion, 151*a*: accommodating groove, 153: adjusting sleeve, 153*a*: second adjusting hole, 153*b*: auxiliary hole, 1531: inner cartridge, 1533: outer cartridge, 155: adjusting member, 157: hook, 157*a*: opening, 157*b*: waist-shaped hole, 158: rotating post, 160: first connecting rod, 161: swing rod, 163: support rod, 170: second connecting rod, 180: elastic member, 190: lock structure, 191: button, 193: clamping member, 1931: clamping portion, 195: restoration member, 197: rope, 200: seat assembly, 210: main seat surface, 210*a*: limiting groove, 220: auxiliary seat surface, 220*a*: clamping groove, 221: clamping block, 223: abutment portion, 300: auxiliary assembly, 310: first swing arm, 311: main body, 3111: guiding surface, 313: bearing portion, 315: limiting portion, 320: second swing arm, and 330: return member.

DETAILED DESCRIPTION OF THE EMBODIMENTS

The following detailed description on preferred embodiments is a preferred mode for implementing the present disclosure. The description does not constitute any limitation, but is intended to illustrate general principles of the present disclosure.

It is to be understood that for ease of understanding on the present disclosure, terms "mounted", "connected", "coupled" and "provided" in the following description refer to connection relationships in the drawings. For example, "connected" may be permanent connection or detachable connection. In addition, "connected" may also be direct connection or indirect connection, or connection through other auxiliary components. Hence, the above terms should not be limitations to actual connection of each component in the present disclosure.

It should be understood that terms "length", "width", "top", "bottom", "front", "rear", "left", "right", "vertical", "horizontal", "upper", "lower", "outside", and "inside" indicate orientations or positional relationships in the accompanying drawings, and are intended to understand the present disclosure easily, rather than limit actual positions or orientations of the present disclosure. Hence, the above terms should not be limitations to actual positions of components in the present disclosure.

It should be understood that terms "first", "second", "a", "an" and "the" refer to "at least one" or "one or more" in the embodiment. Particularly, the term "a" may refer to "one" in an embodiment, and may refer to "more than one" in another embodiment. Hence, the above terms should not be limitations to actual numbers of components in the present disclosure.

To facilitate the understanding of the present disclosure, the present disclosure is described more completely below with reference to the accompanying drawings. Preferred embodiments of the represent disclosure are shown in the drawings. However, the present disclosure is embodied in various forms without being limited to the embodiments set forth herein. On the contrary, these embodiments are provided such that the disclosure of the present disclosure can be understood thoroughly and comprehensively.

Figure 2:
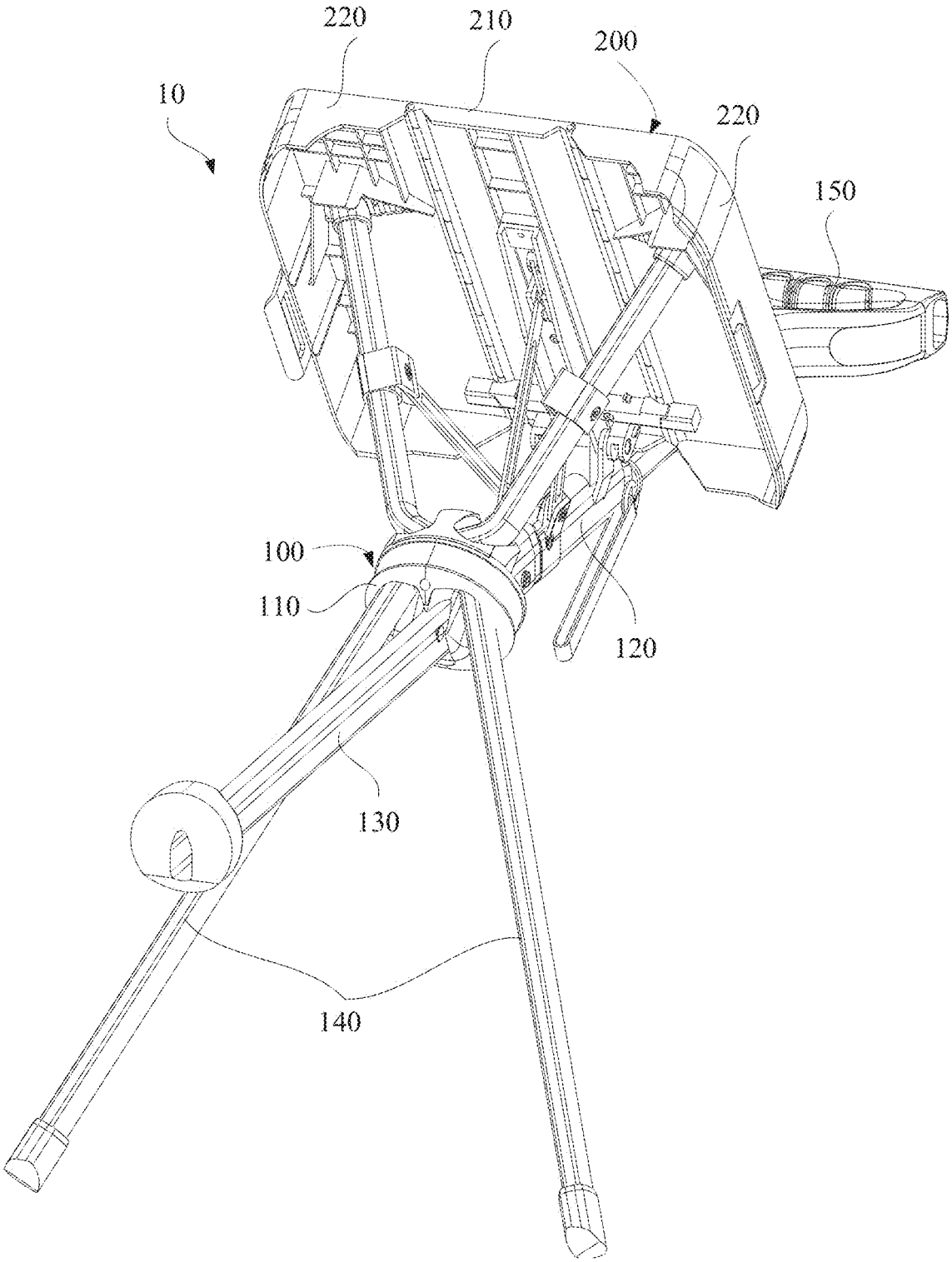
FIG. 2 is a schematic view from another viewing angle of the cane with a seat shown in FIG. 1.
Figure 3:
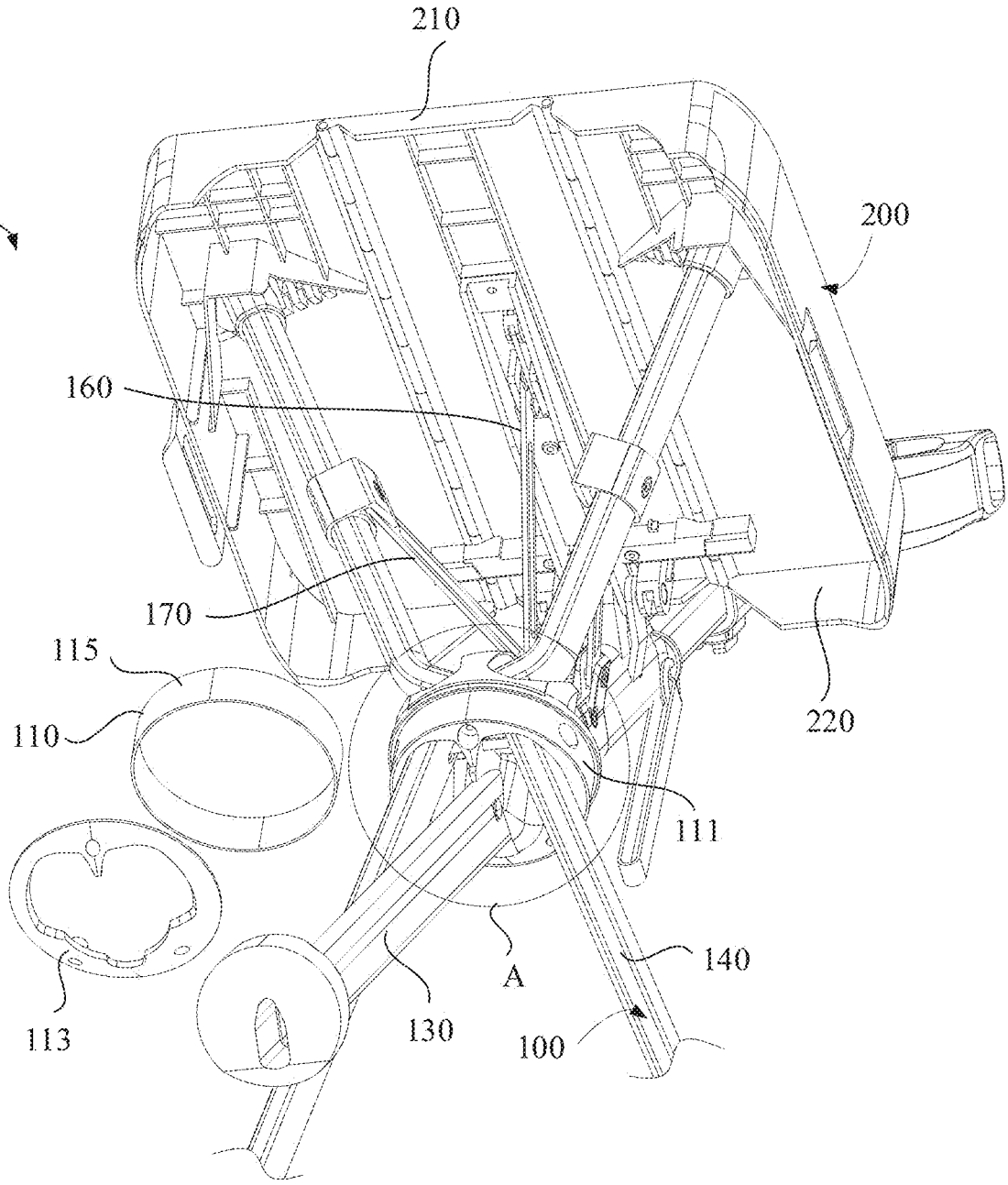
FIG. 3 is an exploded view of the cane with a seat shown in FIG. 2.
Figure 4:
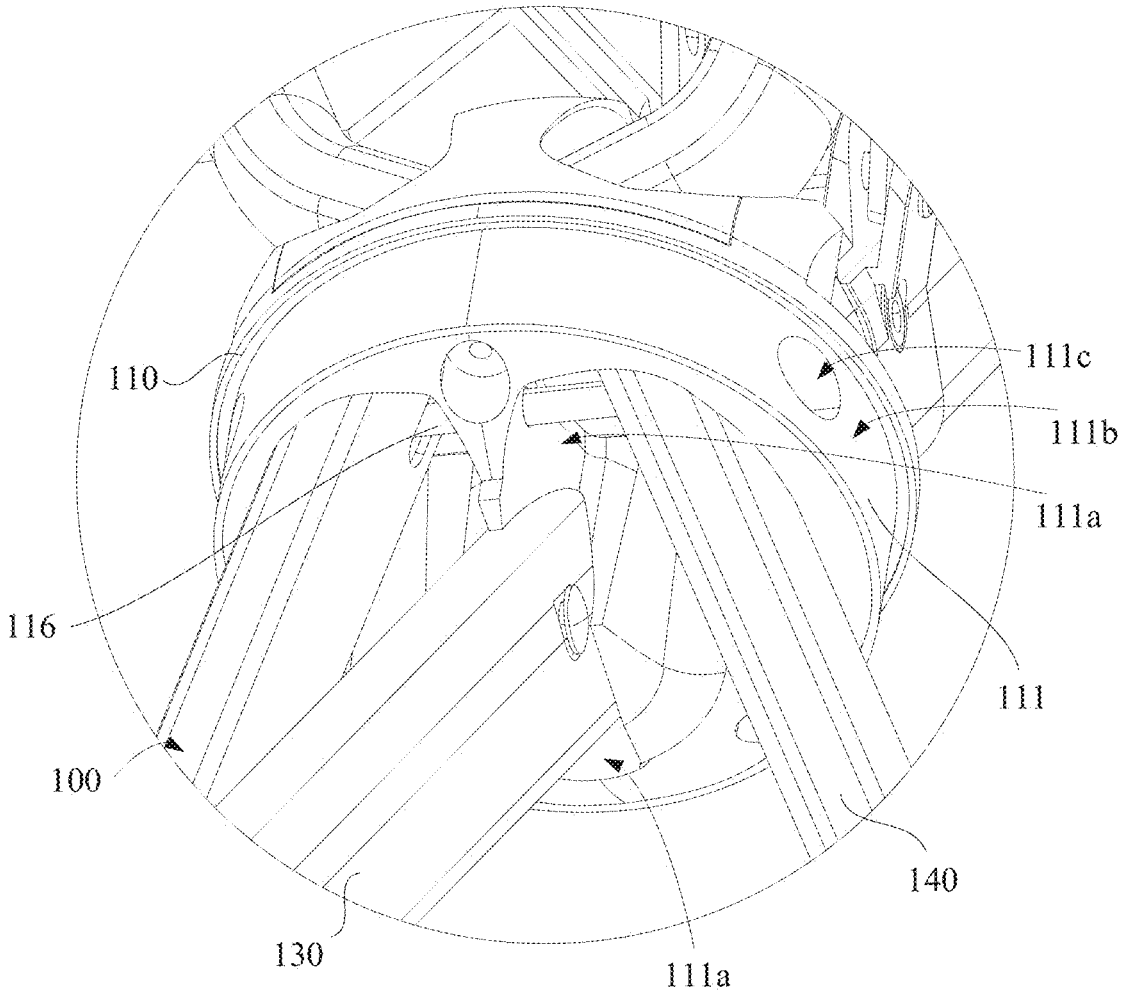
FIG. 4 is a schematic enlarged view of A of the cane with a seat shown in FIG. 3.

Referring to FIG. 1 and FIG. 2, an embodiment of the present disclosure provides a cane with a seat 10, including a support assembly 100 and a seat assembly 200. The support assembly 100 includes a support base 110, a slider 120, a main rod 130, and two auxiliary rods 140. In combination with FIG. 3 and FIG. 4, the main rod 130 and the auxiliary rod 140 penetrate through the support base and are rotatably connected the support base 110. Two opposite ends of each of the main rod 130 and the auxiliary rod 140 are stretched out of the support base 110. For example, by allowing a rotating shaft to penetrate through the main rod 130 and the support base 110, and another rotating shaft to penetrate through the auxiliary rod 140 and the support base 110, the main rod 130 and the auxiliary rod 140 are rotatably connected to the support base 110.

Specifically, the support base 110 may include a main body 111 and a cover plate 113 that are detachably connected. The main body 111 is provided with three through holes 111*a* at intervals. The main rod 130 and the two auxiliary rods 140 penetrate through the three through holes 111*a* in one-to-one correspondence and are rotatably connected to the main body 111. The through holes 111*a* can provide a space for swing of the main rod 130 and the auxiliary rod 140 relative to the support base 110, while limiting a range of movement of the main rod 130 and the auxiliary rod 140. The main rod 130 and the two auxiliary rods 140 can be kept stable in an expanded state and a collapsed state. The main body 111 may be molded by injection to improve the molding efficiency, and may have a relatively large wall thickness to improve the supporting stability. In assembly, the main rod 130 and the auxiliary rod 140 may penetrate through the through hole 111*a* of the main body 111 and the cover plate 113. By this time, the cover plate 113 and the main body 111 may be spaced to expose an internal space of the main body 111, so as to facilitate assembly of the rotating shaft to the main body 111 to realize rotatable connection of the main rod 130 and the auxiliary rod 140 with the main body 111. Upon the assembly of the main body 111 with the main rod 130 and the auxiliary rod 140, the cover plate 113 is used to cover the internal space of the main body 111. For example, the cover plate 113 is reliably fixed on the main body 111 through a fastener such as a bolt, thereby reliably limiting the main rod 130 and the auxiliary rod 140 on the support base 110 to improve the convenience in the assembly.

In some implementations, the support base 110 may include a clamping ring 115. The cover plate 113 and the main body 111 enclose a groove 111*b* extending along a circumferential direction of the main body 111. A shaft hole 111*c* is formed in a bottom of the groove 111*b*. The shaft hole 111*c* is configured to penetrate through a rotating shaft 116 to realize the rotatable connection of the main rod 130 and the auxiliary rod 140 with the main body 111. The clamping ring 115 is limited in the groove 111*b* and conceals the shaft hole 111*c* and the rotating shaft 116. The clamping ring 115 may be of a circumferentially closed annular shape, and may be assembled to the main body 111 prior to the cover plate 113. Two protrusive edges of the groove 111*b* in an axial direction of the main rod 130, namely a protrusive edge of the main body 111 and an edge of the cover plate 113, can prevent easy separation of the clamping ring 115 from the main body 111. The clamping ring 115 can prevent easy separation of the rotating shaft 116 from the main body 111 and take as a decorative effect. In the assembly of the main rod 130 and the auxiliary rod 140 with the support base 110, the main rod 130 and the auxiliary rod 140 may penetrate through the through hole 111*a* of the main body 111, the clamping ring 115 and the cover plate 113 sequentially, such that the clamping ring 115 is limited on the main body 111 reliably, and not separated from the main body 111 easily.

The slider 120 may be of a circumferentially closed tubular shape. Sleeved on the main rod 130, the slider is in sliding fit with the main rod 130, and is configured to drive the support assembly 100 to switch between the collapsed state and the expanded state. In combination with FIG. 5 and FIG. 6, in the collapsed state, the two auxiliary rods 140 are collapsed to the main rod 130. A length extension direction of the auxiliary rod 140 is approximately parallel to a length extension direction of the main rod 130. Referring to FIG. 1 and FIG. 2, in the expanded state, the two auxiliary rods 140 form an included angle with the main rod 130 and are symmetrically located at two opposite sides of the main rod 130.

The seat assembly 200 may include a main seat surface 210 and two auxiliary seat surfaces 220. The two auxiliary seat surfaces 220 are rotatably connected to two opposite sides of the main seat surface 210 in one-to-one correspondence. The main seat surface 210 is rotatably connected to the slider 120. When the support assembly 100 is switched from the collapsed state to the expanded state, the slider 120 drives the main seat surface 210 to expand, the main seat surface 210 drives the auxiliary seat surface 220 to expand, and ends of the two auxiliary rods 140 close to the seat assembly 200 support the two auxiliary seat surfaces 220 in one-to-one correspondence. When the support assembly 100 is switched from the expanded state to the collapsed state, the slider 120 drives the main seat surface 210 to collapse, the main seat surface 210 drives the auxiliary seat surface 220 to collapse, and the ends of the two auxiliary rods 140 close to the seat assembly 200 can be gradually separated from the two auxiliary seat surfaces 220.

It may be understood that the term "symmetric" in engineering technology cannot be strictly deemed as a concept in geometric meaning, and should be understood with considerations to the engineering error, and the case where the two auxiliary rods 140 are not symmetric relative to the main rod 130 within a range of the engineering error should not be excluded from the protection scope of the present disclosure.

In some implementations, the main rod 130 and the auxiliary rod 140 are a hollow tubular structure, and may be an integrated structure, namely the whole tube is molded integrally. The main rod 130 and the auxiliary rod 140 may be made of an aluminum alloy material. The whole cane with a seat 10 has a relatively small weight and is carried by the elderly conveniently. Meanwhile, the main rod 130 and the auxiliary rod 140 have a high structural strength, so as to support the body weight of the elderly reliably in the expanded state to ensure the safety in use.

A handle 150 may further be provided at one end of the main rod 130. The handle 150 can form a circumferentially closed space, so as to be held by a palm of the user conveniently, and facilitate use of the cane with a seat 10. Further, in combination with FIG. 5 and FIG. 6, a length of the main rod 130 may be greater than a length of the auxiliary rod 140. In the collapsed state, at a side of the support base 110 away from the handle 150, a tail end of the main rod 130 may slightly protrude from a tail end of the auxiliary rod 140. With the handle 150 held by the user, and an end of the main rod 130 away from the handle 150 contacting with the ground, the cane with a seat can support the body of the user to serve as a cane with a seat. An end of the auxiliary rod 140 close to the handle 150 may be accommodated in a space enclosed by the main seat surface 210 and the auxiliary seat surfaces 220. This reduces the width of the whole cane with a seat 10 to facilitate use of the cane with a seat, and can prevent easy separation of the end of the auxiliary rod 140 close to the handle 150 from the main rod 130 to cause inconvenience in use. Further, the end of the main rod 130 away from the handle 150 may be provided with a rubber sleeve or a silica gel sleeve. The rubber sleeve or the silica gel sleeve contacts the ground, which relieves the impact, increases the contact area, and improves the supporting stability and the comfort in use.

Figure 5:
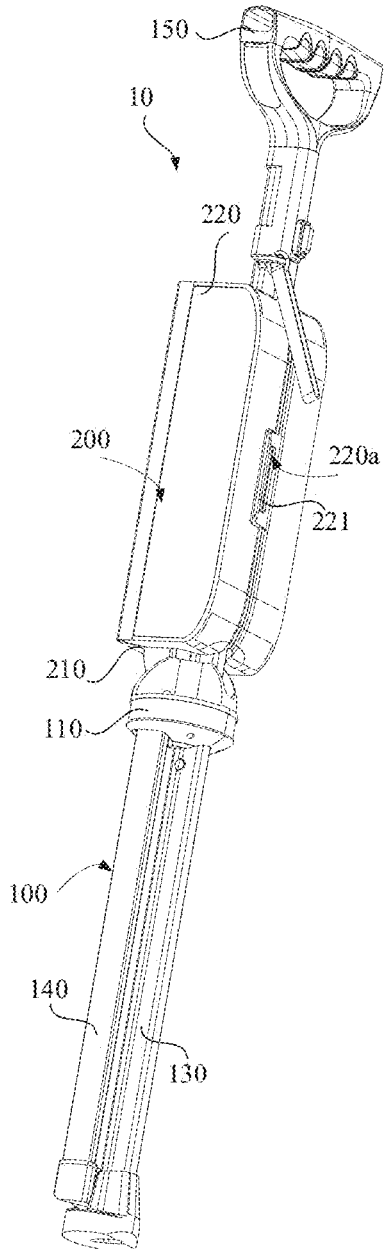
FIG. 5 is a schematic view of a cane with a seat in a collapsed state according to an embodiment.
Figure 6:
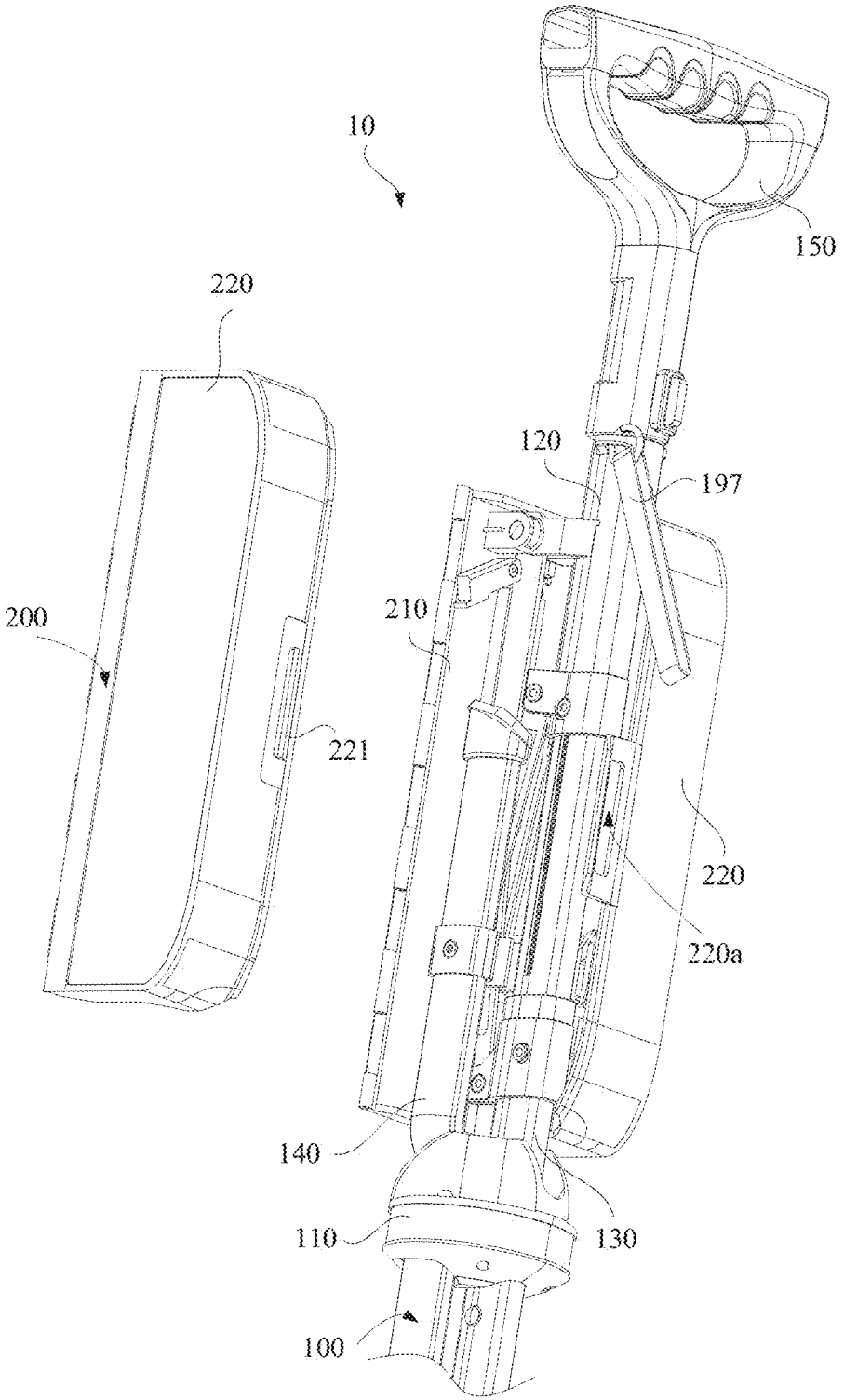
FIG. 6 is an exploded view of the cane with a seat shown in FIG. 5.

Exemplarily, referring to FIG. 5 and FIG. 6, one of the two auxiliary seat surfaces 220 may further be provided with a clamping block 221, and the other is provided with a clamping groove 220*a*. In the collapsed state, the clamping block 221 is buckled into the clamping groove 220*a*, the main seat surface 210 and the auxiliary seat surfaces 220 form a rectangular box-like space, and the ends of the collapsed auxiliary rods 140 close to the seat assembly 200 are accommodated in the space enclosed by the main seat surface 210 and the auxiliary seat surfaces 220. This structure can keep the collapsed state of the cane with a seat 10 stably, and prevent the support assembly 100 and the seat assembly 200 from expanding easily when the cane with a seat 10 is used as the cane with a seat. Certainly, in other implementations, the two auxiliary seat surfaces 220 may further be buckled by means of magnetic attraction, magic tape bonding and the like to stably keep the collapsed state of the cane with a seat 10.

Figure 7:
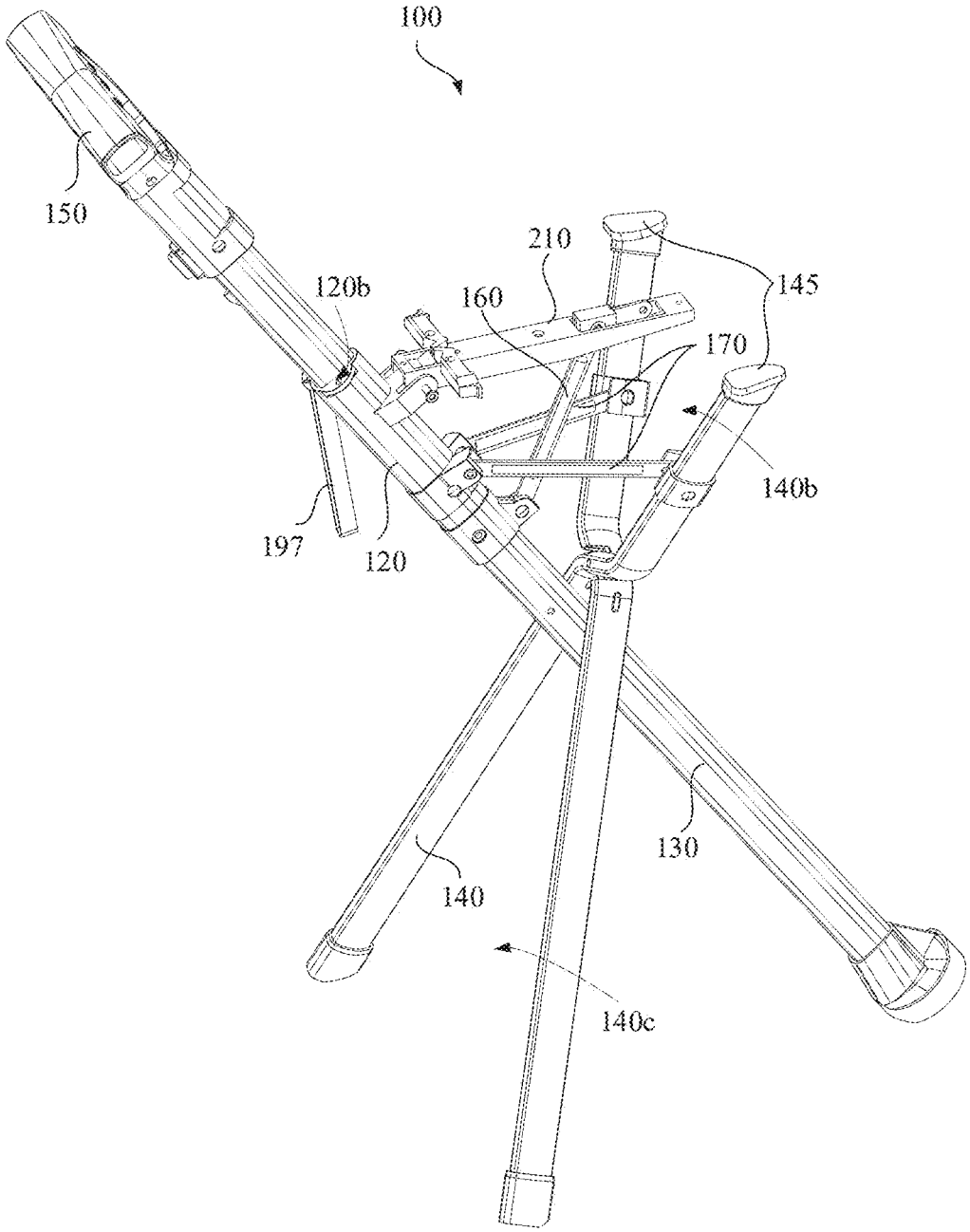
FIG. 7 is a schematic view after a part of structures of the cane with a seat shown in FIG. 1 are removed.
Figure 8:
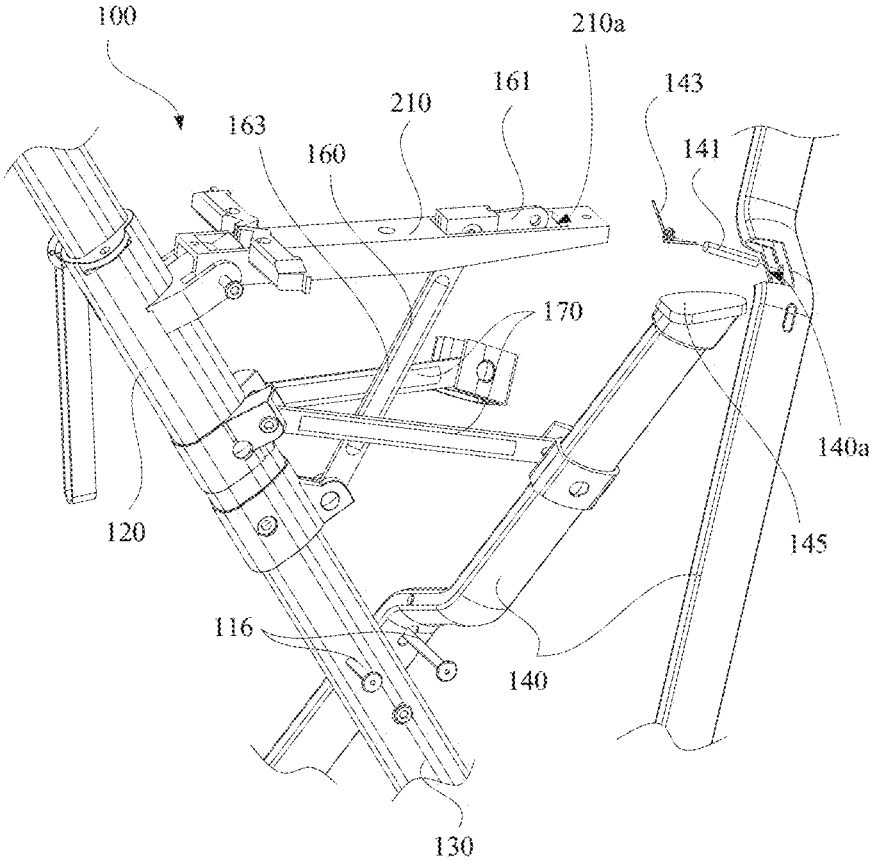
FIG. 8 is an exploded view of the cane with a seat shown in FIG. 7.

Meanwhile, referring to FIG. 7 and FIG. 8, in the expanded state, the two auxiliary rods 140 intersect at the support base 110. A pin shaft 141 may be provided at an intersection between the two auxiliary rods 140 to realize rotatable connection of the two auxiliary rods 140. Further, gaps 140*a* opposite to each other may be formed in the two auxiliary rods 140 respectively. With the gaps 140*a*, the two auxiliary rods 140 are embedded into each other. This makes the two auxiliary rods rotate more stably, while defining the range of rotation of the two auxiliary rods. Further, referring to FIG. 8, a torsional spring 143 may be sleeved on the pin shaft 141. Two free ends of the torsional spring 143 abut against the two auxiliary rods 140 in one-to-one correspondence, such that the two auxiliary rods 140 tend to be spread apart from each other, and the cane with a seat 10 in the collapsed state is spread apart more easily to the expanded state.

Further, referring also to FIG. 7, in the expanded state, the two auxiliary rods 140 form an upper included-angle space 140*b* and a lower included-angle space 140*c*. The main rod 130 penetrates through either of the upper included-angle space 140*b* and the lower included-angle space 140*c*. With FIG. 7 in which the main rod 130 penetrates through the lower included-angle space 140*c* as an example, since the main rod 130 and the auxiliary rod 140 are rotatably connected to the support base 110, a position of the support base 110 relative to the main rod 130 in the axial direction of the main rod 130 is basically unchanged, rotation of the auxiliary rod 140 relative to the support base 110 makes the auxiliary rod swing relative to the main rod 130, and the auxiliary rod 140 may have an appropriate relative movement space with the support base 110 in the axial direction, the support assembly 100 is switched between the collapsed state and the expanded state conveniently. In the expanded state, the two auxiliary rods 140 form an included angle with the main rod 130 and are respectively located at the two opposite sides of the main rod 130. A triangle formed by connecting lines from the end of the main rod 130 away from the handle 150 to ends of the two auxiliary rods 140 away from the handle 150 may be an isosceles triangle. After the user sits on the expanded seat assembly 200, forces applied to the two auxiliary rods 140 at the two sides of the main rod 130 are the same, namely the forces on the two auxiliary rods 140 are balanced. A center of gravity for supporting the user may fall into projection of a symmetric axis of the isosceles triangle, namely the main rod 130, to form a stable support structure. This prevents the unstable supporting problem due to a fact that the force on one auxiliary rod 140 is obviously greater than the force on the other auxiliary rod 140, and thus can ensure the supporting stability and improve the safety in use. Moreover, after the user sits on the expanded seat assembly 200, since the main rod 130 is located in the lower included-angle space 140*c*, the intersection between the two auxiliary rods 140 tends to move close to the main rod 130, and the main rod 130 at the support base 110 also tends to move close to the intersection between the auxiliary rods 140. The main rod 130 may be usually greater than the auxiliary rod 140 in terms of size such as width and wall thickness, and has a larger bearing capacity. The squeezing force generated by the trend of moving close to each other can be borne by the support base 110 and the main rod 130, thereby forming a stable spatial tripod to stably support the user, preventing the support assembly 100 in the expanded state from toppling and falling easily, and improving the safety and comfort in use.

Figure 9:
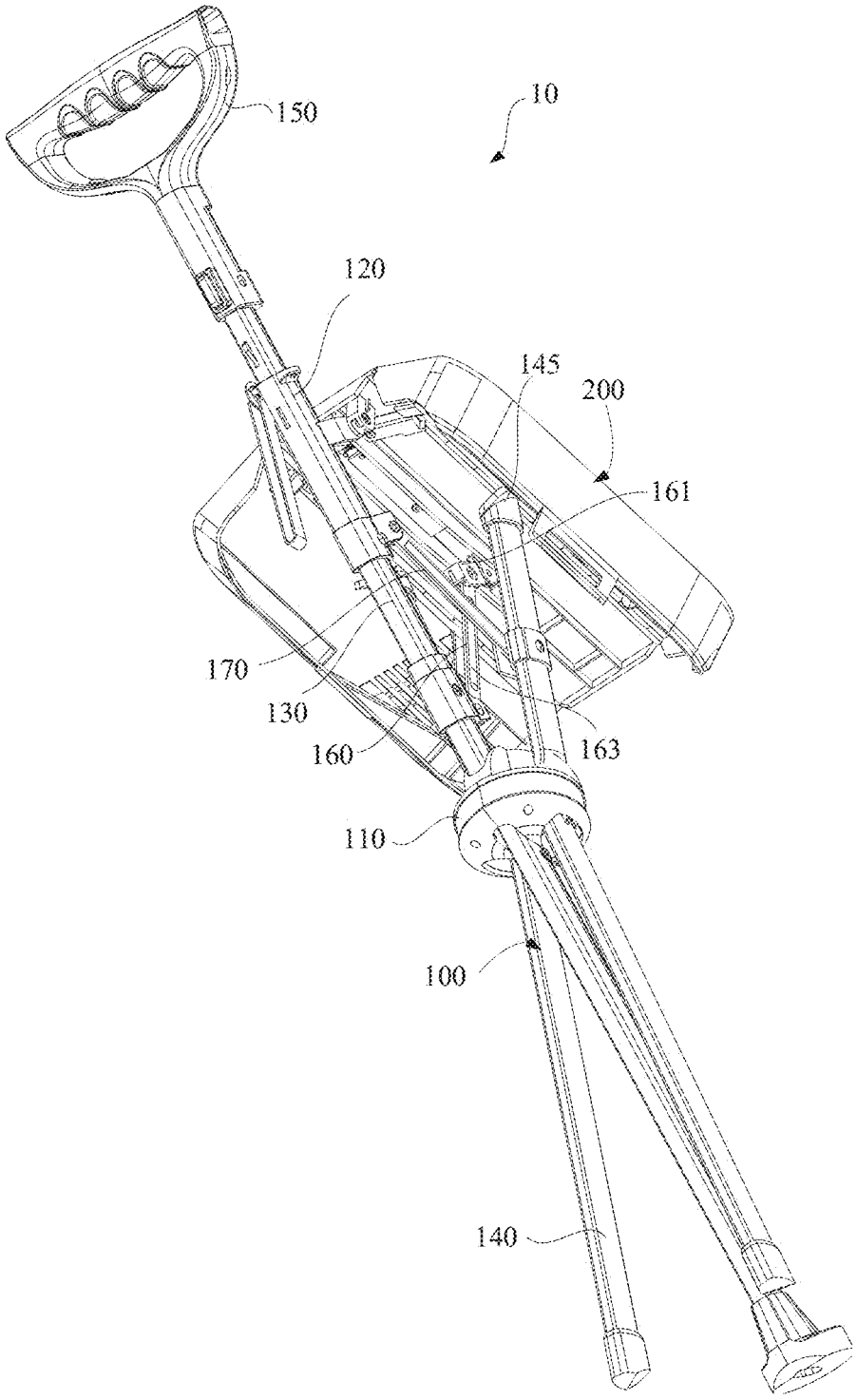
FIG. 9 is a schematic view of a cane with a seat in a state between an expanded state and a collapsed state according to an embodiment.

Referring also to FIG. 7 and FIG. 8, and in combination with FIG. 9, the support assembly 100 may include a first connecting rod 160 and two second connecting rods 170. One end of the first connecting rod 160 is rotatably connected to the main rod 130. Another opposite end of the first connecting rod 160 is connected to the main seat surface 210. A junction between the first connecting rod 160 and the main seat surface 210, and a junction between the main seat surface 210 and the slider 120 are spaced. In the collapsed state, the first connecting rod 160 and the two second connecting rods 170 that are collapsed are also accommodated in the space enclosed by the main seat surface 210 and the auxiliary seat surfaces 220. This makes the cane with a seat 10 in the collapsed state structurally compact, and avoids the overlarge width to affect the convenience in use. A junction between the first connecting rod 160 and the main rod 130 is located between the slider 120 and the support base 110. Ends of the two second connecting rods 170 are rotatably connected to the slider 120. Another opposite ends of the two second connecting rods 170 are rotatably connected to the two auxiliary rods 140 in one-to-one correspondence. The auxiliary rod 140 is provided with a support end 145 for supporting the auxiliary seat surface 220 in the expanded state. A junction between the second connecting rod 170 and the auxiliary rod 140 is located between the support base 110 and the support end 145. A junction between the second connecting rod 170 and the slider 120 is located between the junction between the slider 120 and the main seat surface 210, and the junction between the first connecting rod 160 and the main rod 130. In other words, the junction between the slider 120 and the main seat surface 210, the junction between the second connecting rod 170 and the slider 120, the junction between the first connecting rod 160 and the main rod 130, and the support base 110 are arranged sequentially along an axial extension direction of the main rod 130.

Figure 10:
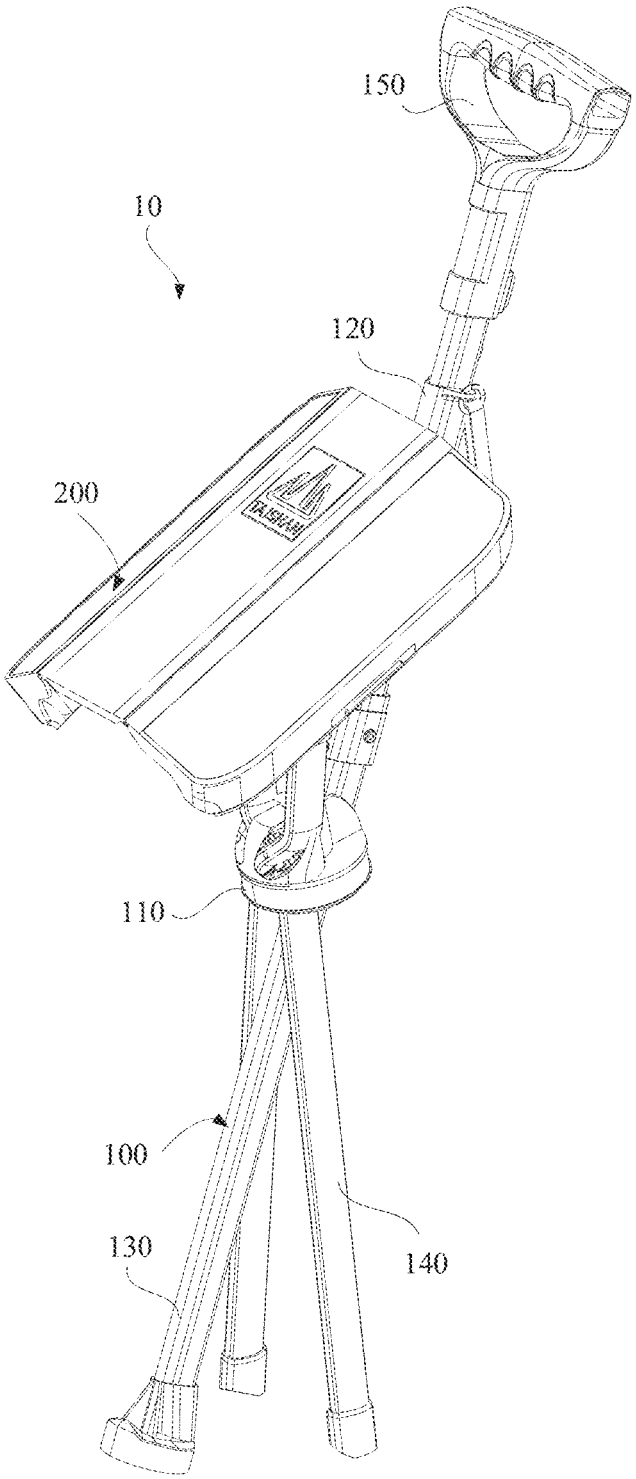
FIG. 10 is a schematic view from another viewing angle of the cane with a seat shown in FIG. 9.

In combination with FIG. 6, FIG. 9 and FIG. 10, the slider 120 in the collapsed state is closer to the handle 150 than the expanded state. When the support assembly 100 is switched from the collapsed state to the expanded state, the slider 120 slides to the support base 110 along the main rod 130. The second connecting rod 170 pushes the end of the auxiliary rod 140 close to the seat assembly 200 away from the main rod 130. The support end 145 of the auxiliary rod 140 can abut against the auxiliary seat surface 220 to drive a free end of the auxiliary seat surface 220 to move gradually away from the support base 110. A free end of the main seat surface 210 moves gradually away from the support base 110. The main seat surface 210 drives the first connecting rod 160 to swing relative to the main rod 130. The first connecting rod 160 swings relative to the main seat surface 210, until supporting the main seat surface 210 in the expanded state (FIG. 2).

Figure 11:
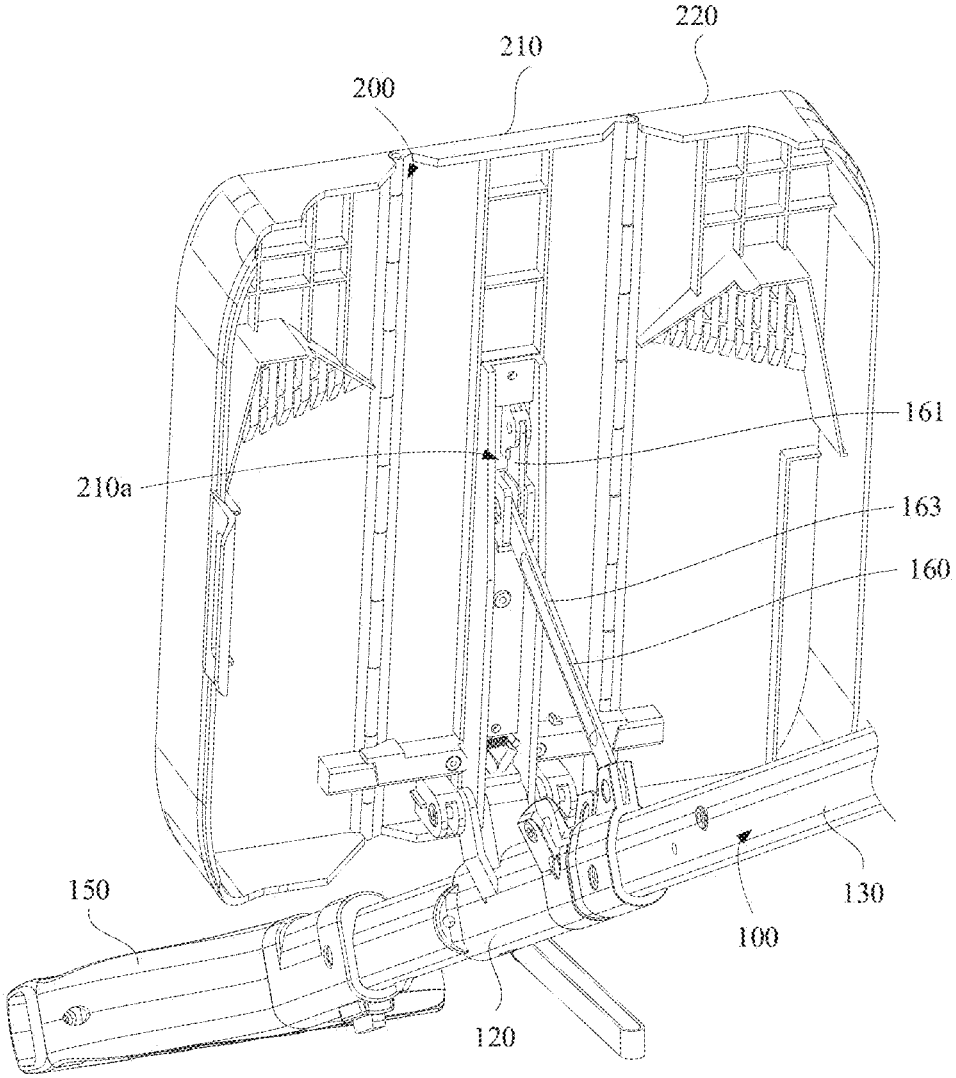
FIG. 11 is a schematic view after a part of structures of the cane with a seat shown in FIG. 1 are removed.

Further, referring to FIG. 11, the first connecting rod 160 includes a swing rod 161 rotatably connected to the main seat surface 210, and a support rod 163 rotatably connected to the swing rod 161. The support rod 163 is rotatably connected to the main rod 130. The main seat surface 210 is provided with a limiting groove **210*a* for limiting a range of rotation of the swing rod 161. When the support assembly 100 is switched between the collapsed state and the expanded state, the swing rod 161 drives the support rod 163 to swing relative to the main seat surface 210. When the support assembly 100 is switched between the collapsed state and the expanded state, namely the free end of the auxiliary seat surface 220 and the free end of the main seat surface 210 move close to and away from the main rod 130, there is a changing distance from a junction (first junction) between the swing rod 161 and the main seat surface 210 to a junction (second junction) between the support rod 163 and the main rod 130. The first connecting rod 160 having a fixed length makes the main seat surface 210 expanded unsmoothly, while the swing rod 161 and the support rod 163 can form a movable joint. As shown in FIG. 9, this adapts to the changing distance between the first junction and the second junction, and the collapse and expansion of the main seat surface 210, such that the main seat surface 210 is collapsed and expanded more smoothly. In the expanded state, the swing rod 161 and the support rod 163 can support the main seat surface 210 jointly, such that the seat assembly 200 is supported stably in the expanded state. Certainly, it may be understood that the swing rod 161 of the first connecting rod 160 may be omitted, provided that two opposite ends of the support rod 163 are rotatably connected to the main rod 130 and the main seat surface 210, namely the main seat surface 210 may also be expanded by the first connecting rod 160** independently in combination with auxiliary operation of the user.

Figure 12:
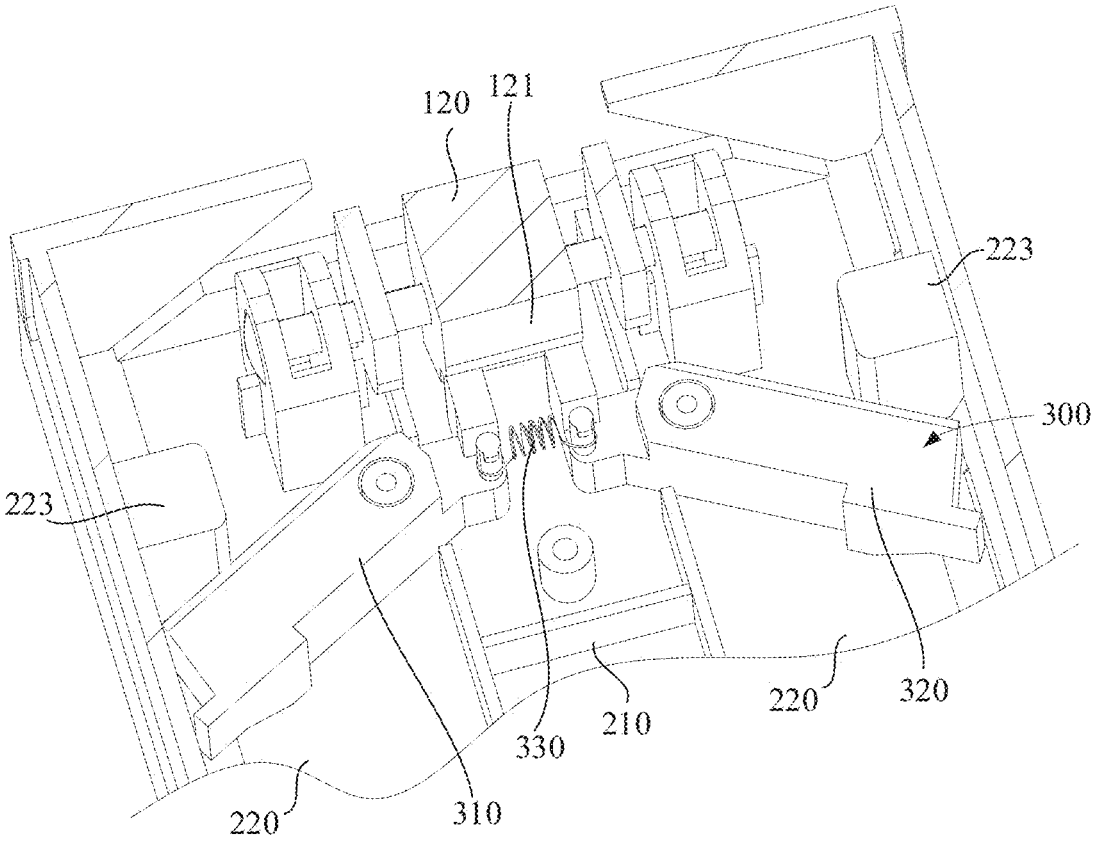
FIG. 12 is a schematic view illustrating relative positions of a slider, an auxiliary assembly and a seat assembly in a collapsed state of the cane with a seat shown in FIG. 5.
Figure 13:
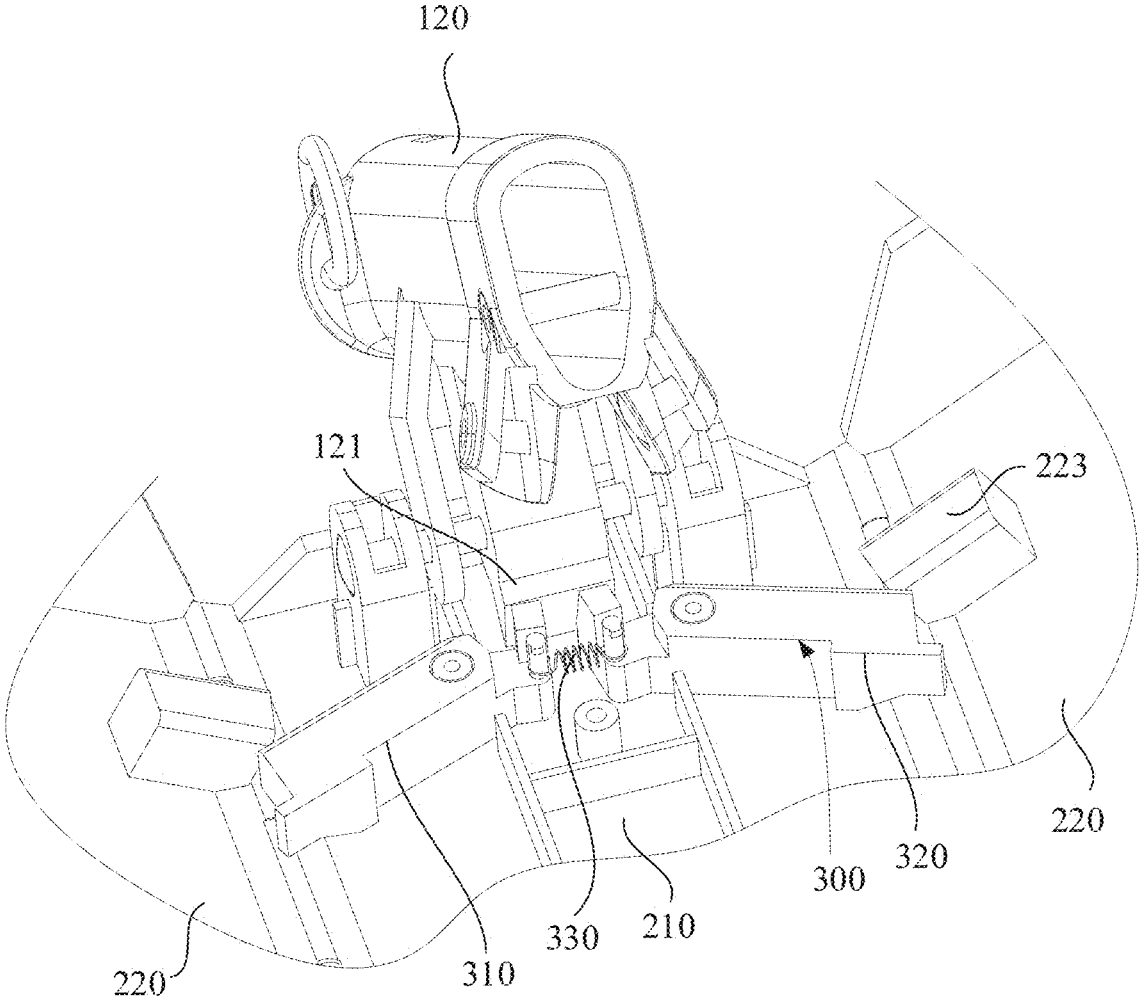
FIG. 13 is a schematic view illustrating relative positions of a slider, an auxiliary assembly and a seat assembly in a state between an expanded state and a collapsed state of the cane with a seat shown in FIG. 9.
Figure 14:
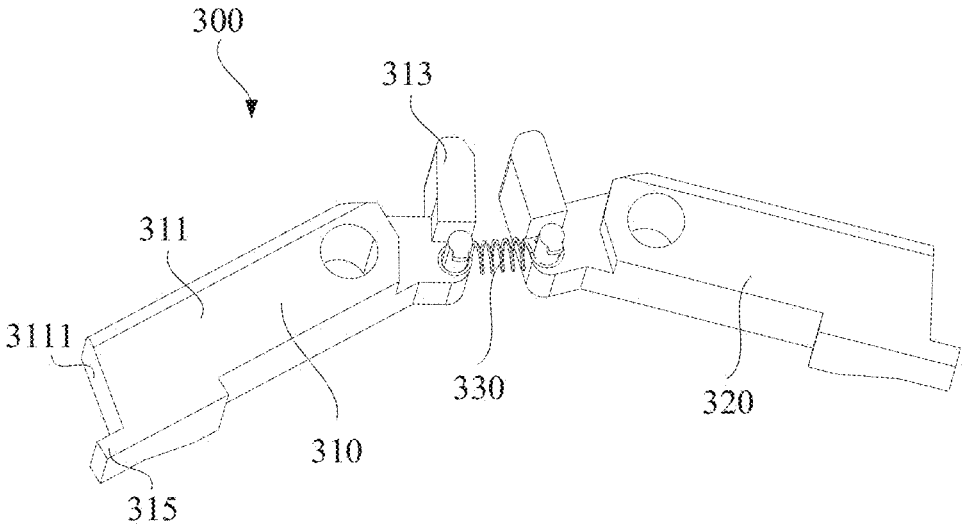
FIG. 14 is a schematic view of the auxiliary assembly shown in FIG. 13.

Referring to FIG. 12, FIG. 13 and FIG. 14, in some implementations, the cane with a seat 10 may include an auxiliary assembly 300. The auxiliary assembly 300 includes a first swing arm 310 and a second swing arm 320 that are rotatably connected to the main seat surface 210. The slider 120 is provided with a protrusion 121. The two auxiliary seat surfaces 220 each are provided with an abutment portion 223. In the expanded state, the first swing arm 310, the second swing arm 320 and the abutment portion 223 are located at a side of the seat assembly 200 away from a support surface (namely a surface for supporting the body of the user in the expanded state), so as to make use of the main seat surface 210 and the auxiliary seat surface 220 to conceal the first swing arm 310, the second swing arm 320 and the abutment portion 223 in the expanded state and the collapsed state, thereby making the cane with a seat 10 aesthetically simpler.

Figure 15:
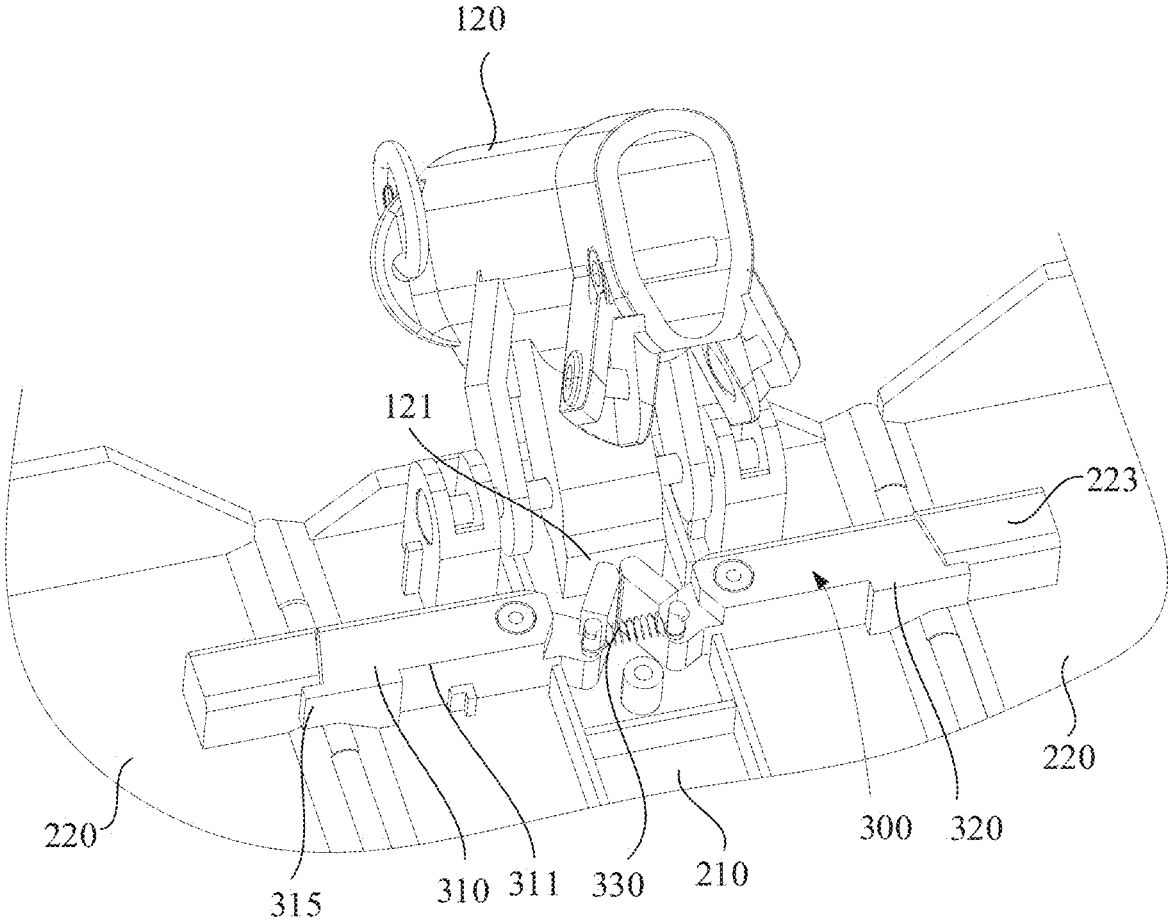
FIG. 15 is a schematic view illustrating relative positions of a slider, an auxiliary assembly and a seat assembly in an expanded state of the cane with a seat shown in FIG. 2.

FIG. 12 illustrates relative positions of the first swing arm 310, the second swing arm 320, the main seat surface 210 and the auxiliary seat surface 220 in the collapsed state of the support assembly 100. FIG. 13 illustrates relative positions of the first swing arm 310, the second swing arm 320, the main seat surface 210 and the auxiliary seat surface 220 at a position between the collapsed state and the expanded state. In combination with FIG. 15, FIG. 15 illustrates relative positions of the first swing arm 310, the second swing arm 320, the main seat surface 210 and the auxiliary seat surface 220 in the expanded state.

When the support assembly 100 is switched from the collapsed state to the expanded state, the protrusion 121 presses the first swing arm 310 and the second swing arm 320, and drives the first swing arm 310 and the second swing arm 320 to rotate relative to the main seat surface 210. The first swing arm 310 presses the abutment portion 223 at one side, and the second swing arm 320 presses the abutment portion 223 at the other side, such that the two auxiliary seat surfaces 220 are expanded relative to the main seat surface 210. In the collapsed state, the main seat surface 210, the auxiliary seat surface 220, the main rod 130 and the auxiliary rod 140 may be approximately parallel to each other. When the slider 120 slides to the support base 110 along the main rod 130, it is relatively difficult to expand the auxiliary seat surface 220 with a lateral force of the support end 145 of the auxiliary rod 140 in an initial stage of expansion, and there is always a further need to pull the free end of the main seat surface 210 away from the main rod 130 with the hand. However, with one hand holding the main rod 130 or the handle 150, and one hand pushing the slider 120, it is hard to take the main seat surface 210 into account to cause unsmooth expansion. The auxiliary assembly 300 may be helpful to expand the auxiliary seat surface 220 relative to the main seat surface 210, thereby expanding the seat assembly 200 more smoothly and improving the convenience in use.

Specifically, referring to FIG. 13 and FIG. 14, the auxiliary assembly 300 may include a return member 330 connected to the main seat surface 210. The return member 330 is connected to at least one of the first swing arm 310 and the second swing arm 320. When the support assembly 100 is switched from the expanded state to the collapsed state, the return member 330 drives the first swing arm 310 and the second swing arm 320 for restoration, namely, the first swing arm 310 and the second swing arm 320 are restored to an initial position, so as to facilitate expansion of the seat assembly 200 in next time. The return member 330 is not limited to a spring or a torsional spring, and may also be a structure such as an elastic post. With the spring shown in FIG. 14 as an example, the spring in the collapsed state may be in a natural unstretched state. When the protrusion 121 of the slider 120 drives the first swing arm 310 and the second swing arm 320 to swing relative to the main seat surface 210, namely the support assembly 100 is switched from the collapsed state to the expanded state, the spring is stretched to accumulate an elastic force, such that the first swing arm 310 and the second swing arm 320 tend to rotate back to the initial position. When the support assembly 100 is switched from the expanded state to the collapsed state, the spring may release elastic potential energy to drive the first swing arm 310 and the second swing arm 320 to restore to the initial position.

Particularly, in some implementations, the first swing arm 310 and the second swing arm 320 may be engaged with each other through an incomplete gear to realize synchronous swing of the first swing arm and the second swing arm relative to the main seat surface 210, thereby realizing synchronous movement of the two auxiliary seat surfaces 220 to improve the convenience in use.

The first swing arm 310 and the second swing arm 320 have a same structure and a same working principle. Herein, the first swing arm 310 is used as an example for description. Referring to FIG. 14, the first swing arm 310 includes a body 311 and a bearing portion 313 that are molded integrally. The body 311 is approximately a rectangular block. The bearing portion 313 is connected to one end of the body 311 and is oblique to a length extension direction of the body 311. Another opposite end of the body 311 is provided with a guiding surface 3111. The guiding surface 3111 is a plane and is oblique relative to a length direction of the body 311. The body 311 is rotatably connected to the main seat surface 210. For example, the main seat surface 210 is provided with a rotating shaft perpendicular to the support surface (namely the surface for supporting the body of the user in the expanded state) of the main seat surface. The body 311 is provided with a hole rotatably cooperating with the rotating shaft. When the support assembly 100 is switched from the collapsed state to the expanded state, the protrusion 121 presses the bearing portion 313 and drives the body 311 to rotate relative to the main seat surface 210. The guiding surface 3111 presses the abutment portion 223 corresponding to the first swing arm 310, so as to drive the corresponding main seat surface 210 to rotate relative to the main seat surface. In some implementations, the abutment portion 223 is provided with a plane matching with the guiding surface 3111. For example, the guiding surface 3111 has an oblique angle of 45° to 60° relative to the length direction of the body 311. The matching plane of the abutment portion 223 basically has a same oblique angle relative to a width direction of the auxiliary seat surface 220. When the support assembly 100 is expanded completely, the guiding surface 3111 is attached to the matching plane, such that a surface of the main seat surface 210 and a surface of the auxiliary seat surface 220 that contact the body of the user are kept at a relatively flat state.

Further, in combination with FIG. 15, the first swing arm 310 may further include a limiting portion 315 integrally molded with the body 311. The limiting portion 315 protrudes from the guiding surface 3111 along the length extension direction of the body 311. When the protrusion 121 presses the bearing portion 313, the protrusion 121 limits a range of movement of the body 311, so as to prevent a range of movement of the first swing arm 310 from being overlarge to affect the support to the auxiliary seat surface 220.

Figure 16:
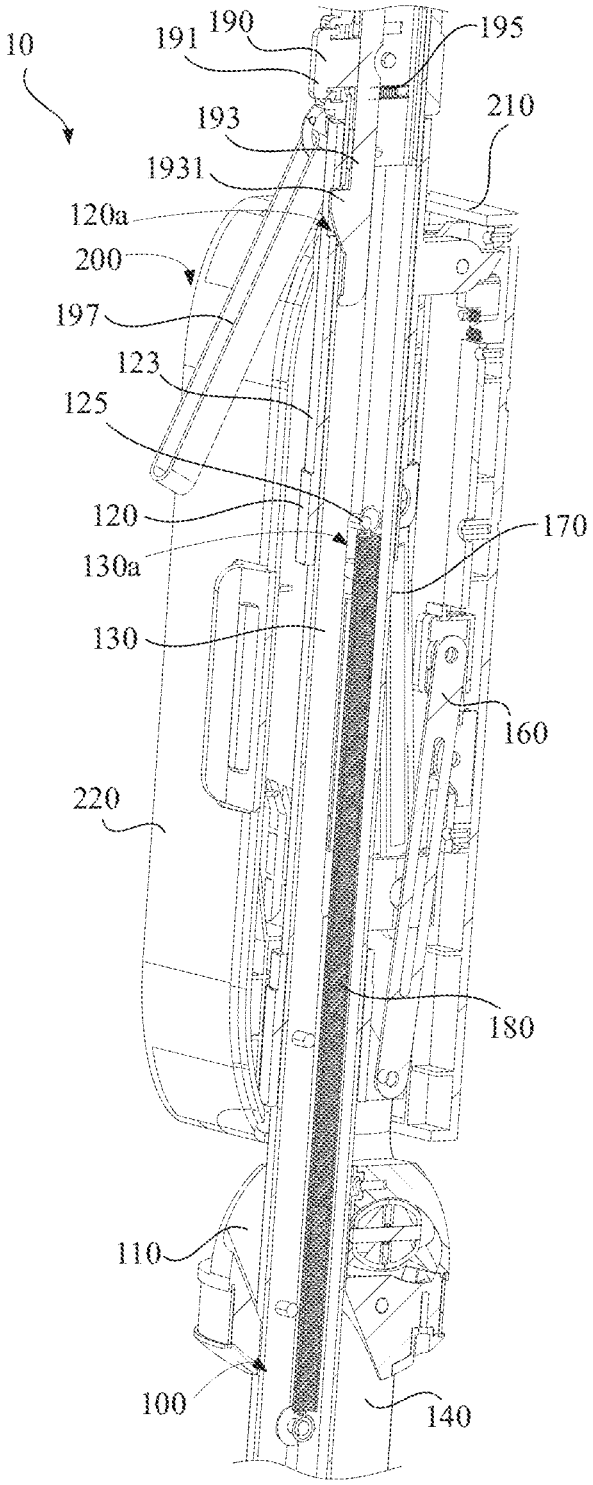
FIG. 16 is a sectional view in a collapsed state of the cane with a seat shown in FIG. 5.
Figure 17:
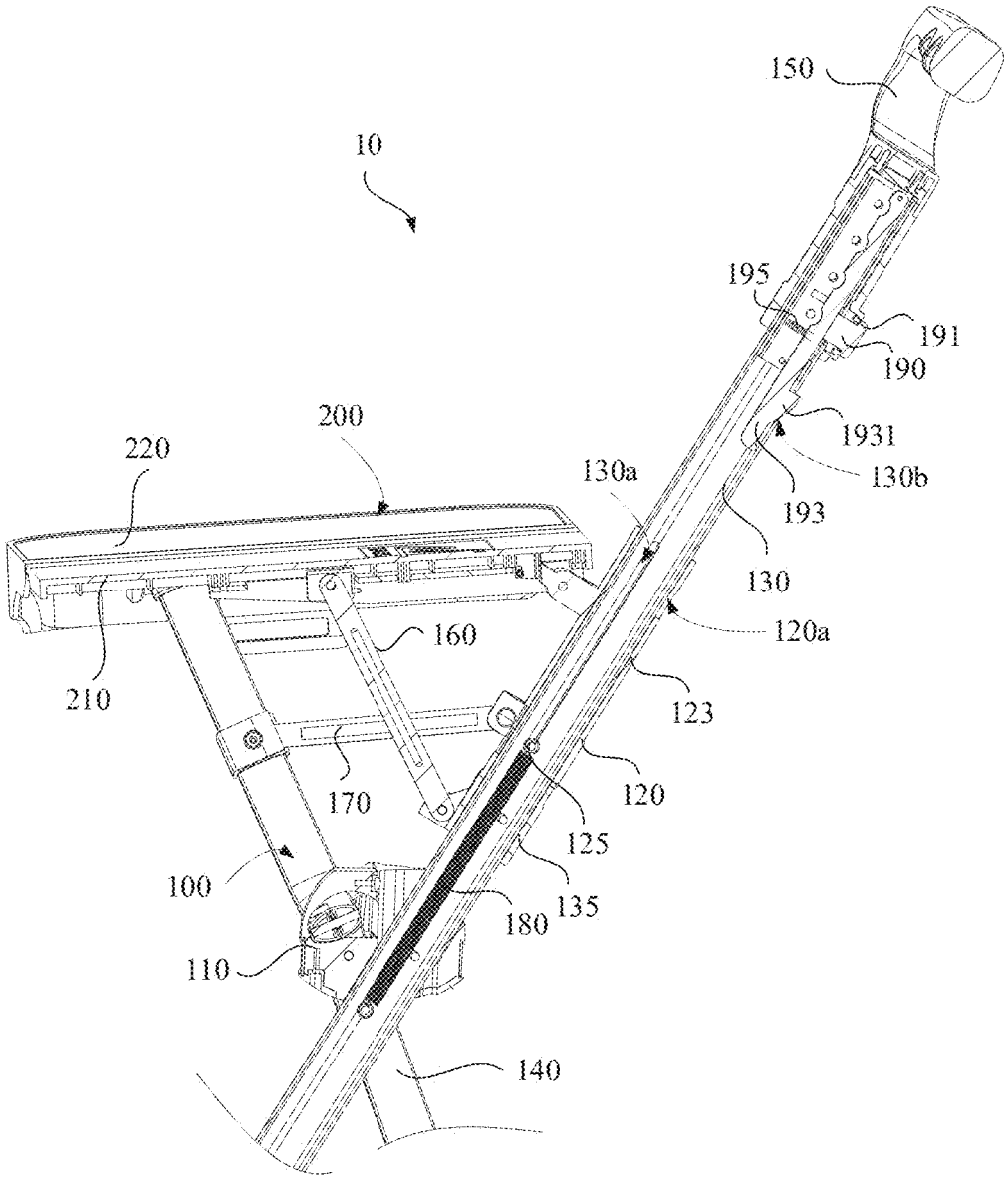
FIG. 17 is a sectional view in an expanded state of the cane with a seat shown in FIG. 1.

Referring to FIG. 16 and FIG. 17, in some implementations, the cane with a seat 10 may further include an elastic member 180 provided in the main rod 130. One end of the elastic member 180 is connected to the slider 120. The other end of the elastic member 180 is connected to the main rod 130. An amount of elastic deformation of the elastic member 180 in the collapsed state (FIG. 16) is greater than an amount of elastic deformation of the elastic member in the expanded state (FIG. 17), so as to drive the slider 120 to slide along the main rod 130 in the collapsed state, thereby switching to the expanded state. In combination with FIG. 17, a through groove **130*a* may be formed in the main rod 130. The slider 120 includes a sleeve 123 and a connecting pin 125 connected to the sleeve 123. The protrusion 121 is integrally molded on the sleeve 123. The sleeve 123 is slidably sleeved on the main rod 130. The second connecting rod 170 and the main seat surface 210 are rotatably connected to the sleeve 123. The connecting pin 125 penetrates through the through groove 130*a*. Two ends of the connecting pin 125 may be riveted into a structure wider than the through groove 130*a*, so as to prevent separation of the connecting pin 125 from the through groove 130*a*. The elastic member 180 includes one end connected to the connecting pin 125, and the other end connected to the main rod 130. When the sleeve 123 slides along the main rod 130, the connecting pin 125 slides along the through groove 130*a* to realize elastic extension and retraction of the elastic member 180. Certainly, it may be understood that the elastic member 180 as well as the through groove 130*a* and the connecting pin 125** that are associated with the elastic member may be omitted. In this case, the expanded state and the collapsed state may also be switched through manual operation of the user.

Further, the cane with a seat 10 may include a lock structure 190 movably connected to the handle 150. In the collapsed state, the lock structure 190 locks the slider 120 at the main rod 130. The lock structure 190 can further unlock the slider 120, thereby switching to the expanded state. Specifically, the lock structure 190 includes a button 191 movably connected to the handle 150 and a clamping member 193. An end of the clamping member 193 close to the support base 110 is provided with a protrusive clamping portion 1931. In combination with FIG. 18 and FIG. 19, a first clamping hole 130*b* is formed in the main rod 130. A second clamping hole 120*a* is formed in the slider 120. In the collapsed state, the first clamping hole 130*b* and the second clamping hole 120*a* communicate to penetrate through the clamping portion 1931, thereby locking the slider 120 at the main rod 130. When the button 191 is pressed by the user, the clamping portion 1931 is withdrawn from the second clamping hole 120*a* to unlock the slider 120. In other words, in the collapsed state, with the clamping portion 1931 penetrating through the first clamping hole 130*b* and the second clamping hole 120*a*, the slider 120 may be locked at the main rod 130, such that the support assembly 100 is stably kept at the collapsed state to realize a function of the cane with a seat.

In some implementations, the lock structure 190 may further include a restoration member 195 abutting against the main rod 130 and the clamping member 193. After the second clamping hole 120*a* moves from a misplaced state to an aligned state relative to the first clamping hole 130*b*, the restoration member 195 drives the clamping portion 1931 to penetrate into the second clamping hole 120*a* to realize automatic clamping between the clamping portion 1931 and the slider 120. The restoration member 195 is not limited to a spring, and may also be an elastic piece or an elastic post. In some implementations, the restoration member 195 corresponds to the button 191, and may also be configured to restore the button 191.

When the cane with a seat 10 is to be used as a chair, after the two auxiliary seat surfaces 220 are unlocked, the button 191 is pressed. Driven by the button 191, the clamping portion 1931 is withdrawn from the second clamping hole 120*a*. Under an action of a tensile force of the elastic member 180, the slider 120 slides automatically down along the main rod 130. The free ends of the two auxiliary seat surfaces 220 and the free end of the main seat surface 210 connected to the auxiliary seat surfaces 220 are supported away from the main rod 130 by the two second connecting rods 170 through the two auxiliary rods 140. The auxiliary assembly 300 drives the two auxiliary seat surfaces 220 to expand relative to the main seat surface 210. The main seat surface 210 drives the support rod 163 through the swing rod 161 to swing relative to the main rod 130, so as to support the main seat surface 210, until the seat assembly 200 is spread apart to the expanded state. Certainly, it may be understood that the lock structure 190 may be omitted. When the lock structure 190 is omitted or broken down, the collapsed state and the expanded state may be switched through manual operation of the user.

Referring also to FIG. 17, in some implementations, the support rod 163 may be rotatably connected to the main rod 130 through a limiting sleeve 135. For example, the limiting sleeve 135 is sleeved to the main rod 130, with a position fixed relative to the main rod 130. A width of the limiting sleeve 135 is greater than a width of the main rod 130. A width of an inner hole of the slider 120 is smaller than the width of the limiting sleeve 135. When the slider 120 slides down along the main rod 130, the slider 120 may abut against the limiting sleeve 135. The limiting sleeve 135 can limit a range of movement of the slider 120 sliding down along the main rod 130. The handle 150 and the lock structure 190 can limit a range of movement of the slider 120 sliding up along the main rod 130. For example, when the slider 120 slides down along the main rod 130 and abuts against the limiting sleeve 135, the expanded state of the support assembly 100 is achieved. When the slider 120 slides up along the main rod 130 and is locked by the lock structure 190, the collapsed state of the support assembly 100 is achieved.

When the support assembly 100 is to be collapsed, namely the support assembly 100 is switched from the expanded state to the collapsed state, the slider 120 may be held and pulled up along the main rod 130, such that the junction between the second connecting rod 170 and the slider 120 moves up along the main rod 130, until the second clamping hole 120*a* of the slider 120 is clamped with the clamping portion 1931 of the lock structure 190, thereby achieving the collapsed state of the support assembly 100. In this process, the slider 120 pulls the ends (namely support ends 145) of the two auxiliary rods 140 close to the seat assembly 200 to move close to the main rod 130, and the squeezing action of the protrusion 121 on the slider 120 to the first swing arm 310 and the second swing arm 320 is reduced. The free end of the main seat surface 210 moves gradually close to the main rod 130. The swing rod 161 drives the end of the support rod 163 away from the main rod 130 to move close to the handle 150, and gradually close to the main rod 130. Under an action of the return member 330, the first swing arm 310 and the second swing arm 320 rotate relative to the main seat surface 210 and are gradually restored to the initial position. The support force of the auxiliary rod 140 to the auxiliary seat surface 220 is gradually reduced. The two auxiliary seat surfaces 220 under an action of a gravity rotate relative to the main seat surface 210 and move close to the main rod 130. The elastic member 180 connected to the main rod 130 and the slider 120 in the main rod 130 is stretched to accumulate the elastic potential energy, such that the slider 120 and the clamping portion 1931 are clamped reliably, and the support assembly 100 is kept at the collapsed state stably. The two auxiliary seat surfaces 220 can be buckled, such that the seat assembly 200 is also kept at the collapsed state stably.

Further, referring also to FIG. 16, and in combination with FIG. 1 and FIG. 7, in some implementations, in a direction perpendicular to a length extension direction of the main rod 130, two opposite sides of the slider 120 each are provided with a hanging hole 120*b*. The hanging hole 120*b* is configured to connect a rope 197 or hang other articles. In the implementation of the present disclosure, the hanging hole 120*b* is located at an end of the slider 120 away from the support base 110, and connected to the rope 197. In the expanded state of the support assembly 100, the slider 120 may be pulled through the rope 197 to move up, thereby improving the convenience in use. Certainly, in the collapsed state of the support assembly 100, the rope 197 may be hung to a hook or other positions, to facilitate placement of the cane with a seat 10.

Figure 18:
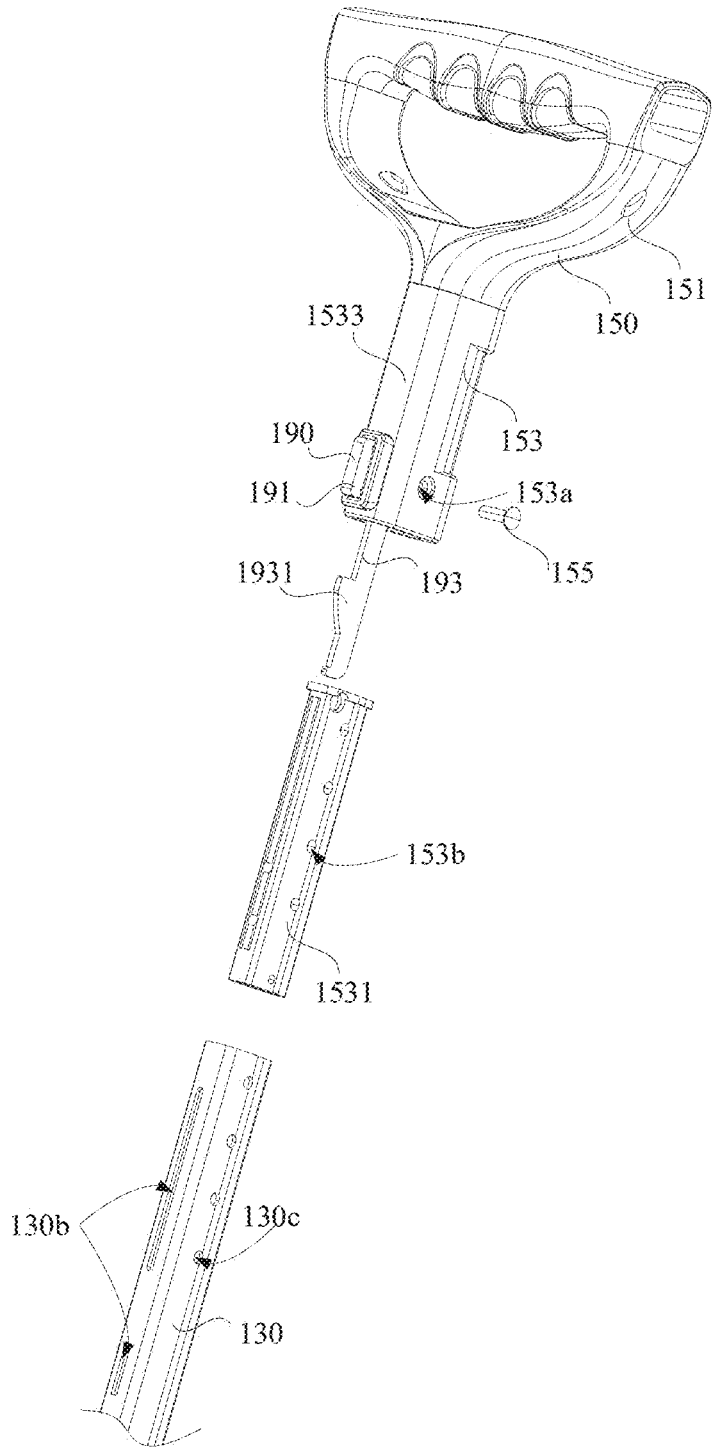
FIG. 18 is an exploded view of a handle and a main rod of a cane with a seat according to an embodiment.
Figure 19:
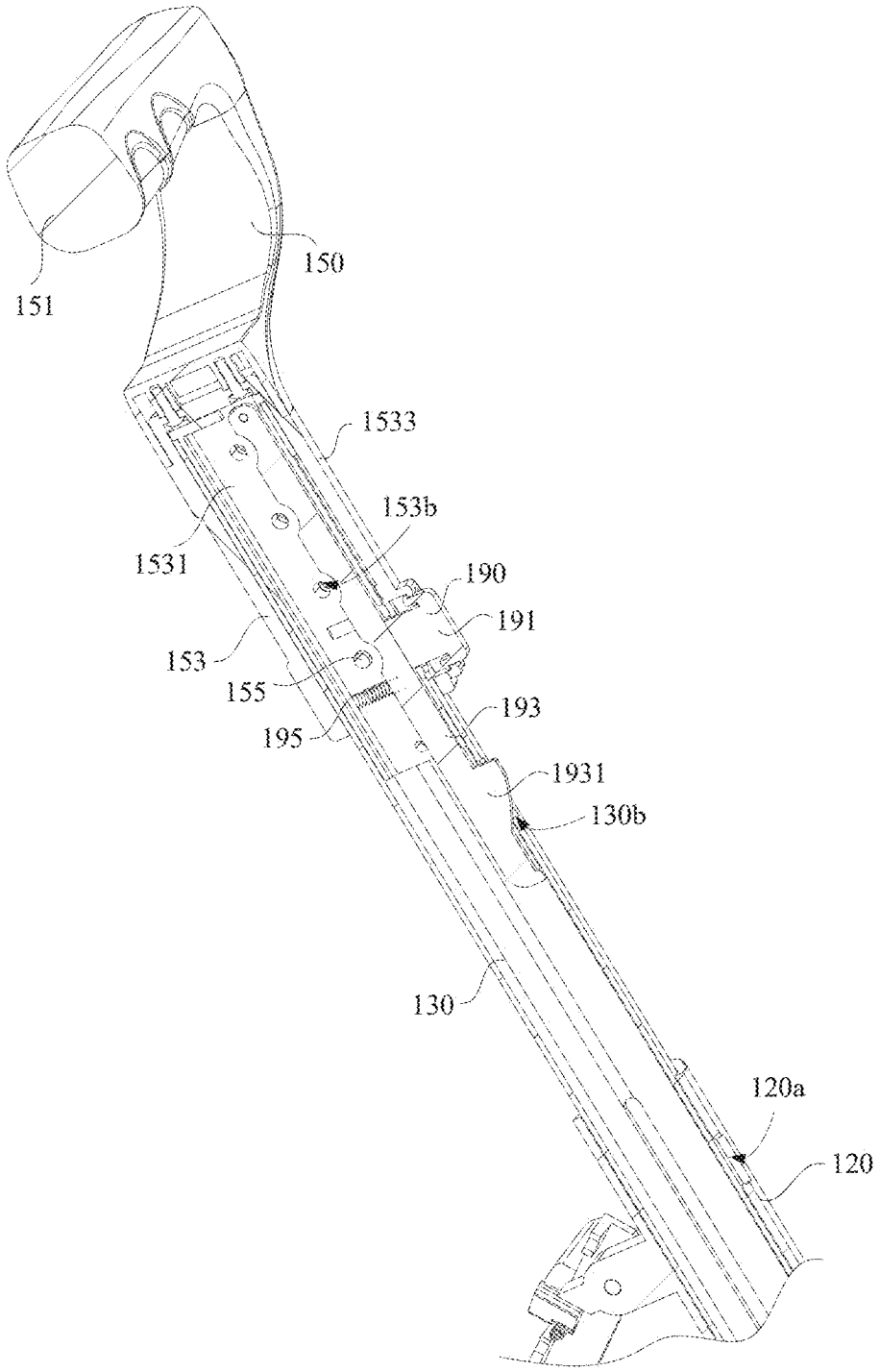
FIG. 19 is a sectional view of a handle, a main rod and a slider in an expanded state of the cane with a seat shown in FIG. 1.

Referring also to FIG. 18 and FIG. 19, in some implementations, the handle 150 may include a gripping portion 151, an adjusting sleeve 153 connected to the gripping portion 151, and an adjusting member 155 detachably connected to the adjusting sleeve 153. The main rod 130 penetrates through the adjusting sleeve 153 and is provided with at least two first adjusting holes 130*c* arranged at intervals along the axial direction of the main rod 130. A second adjusting hole 153*a* is formed in the adjusting sleeve 153. The adjusting member 155 penetrates through the second adjusting hole 153*a* and one of the first adjusting holes 130*c*, such that positions of the main rod 130 and the handle 150 are fixed relatively. After the adjusting member 155 is detached from the second adjusting hole 153*a*, the gripping portion 151 can drive the adjusting sleeve 153 to move relative to the main rod 130, such that the second adjusting hole 153*a* is aligned to any one of remaining first adjusting holes 130*c*, thereby penetrating through the adjusting member 155 and adjusting the relative positions of the gripping portion 151 and the main rod 130. The adjusting member 155 may be a bolt, or a similar part provided with a thread. The adjusting member may penetrate through the first adjusting hole 130*c* and the second adjusting hole 153*a* to limit the handle 150 in the axial direction of the main rod 130. Hence, there is an adjustable distance between the gripping portion 151 and the end of the main rod 130 away from the handle 150, namely an adjustable overall length of the main rod 130 and the handle 150. This can adapt to people having different heights, and improves the comfort and convenience in use.

Specifically, the adjusting sleeve 153 may include an inner cartridge 1531 connected to the gripping portion 151, and an outer cartridge 1533 connected to the gripping portion 151 and sleeved on the inner cartridge 1531. The adjusting member 155 is detachably connected to the outer cartridge 1533 and the inner cartridge 1531. The end of the main rod 130 close to the handle 150 penetrates through a space between the inner cartridge 1531 and the outer cartridge 1533. The outer cartridge 1533 is provided with the second adjusting hole 153*a*. The inner cartridge 1531 is provided with an auxiliary hole 153*b* aligned to the second adjusting hole 153*a*. The adjusting member 155 penetrates through the auxiliary hole 153*b*, the second adjusting hole 153*a* and one of the first adjusting holes 130*c*, such that the positions of the main rod 130 and the handle 150 are fixedly relatively. With the structure that the adjusting member 155 penetrates through the auxiliary hole 153*b* and the second adjusting hole 153*a*, the adjusting member 155 can be supported by a wall of the auxiliary hole 153*b* and a wall of the second adjusting hole 153*a* to form a more stable support structure. This makes the adjusting sleeve 153 limit the main rod 130 more stably and reliably.

Since the inner cartridge 1531 and the outer cartridge 1533 are adjustable relative to the main rod 130, in some implementations, the button 191 of the lock structure 190 is provided on the outer cartridge 1533, with an axial position on the outer cartridge 1533 kept unchanged. The clamping member 193 of the lock structure 190 is connected to the gripping portion 151, and can swing in a small range relative to the gripping portion 151, so as to withdraw from the second clamping hole 120*a* of the slider 120 or entering the second clamping hole 120*a*. The first clamping hole 130*b* in the main rod 130 may be an elongated groove structure extending along the axial direction of the main rod 130. When the main rod 130 moves along the axial direction relative to the handle 150, the clamping portion 1931 moves along the elongated first clamping hole 130*b* and is kept in the first clamping hole 130*b*, such that the lock structure 190 can lock the slider 120 timely.

Figure 20:
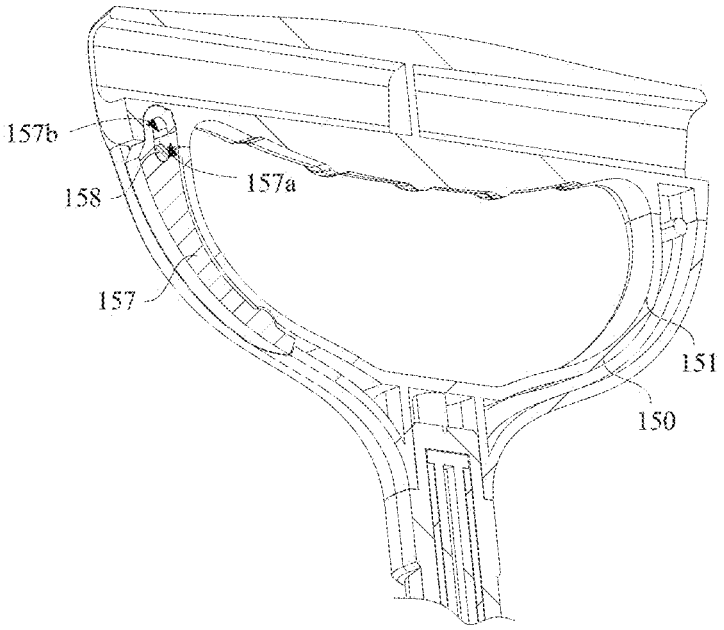
FIG. 20 is a sectional view of a buckled state of a hook of a cane with a seat according to an embodiment.
Figure 21:
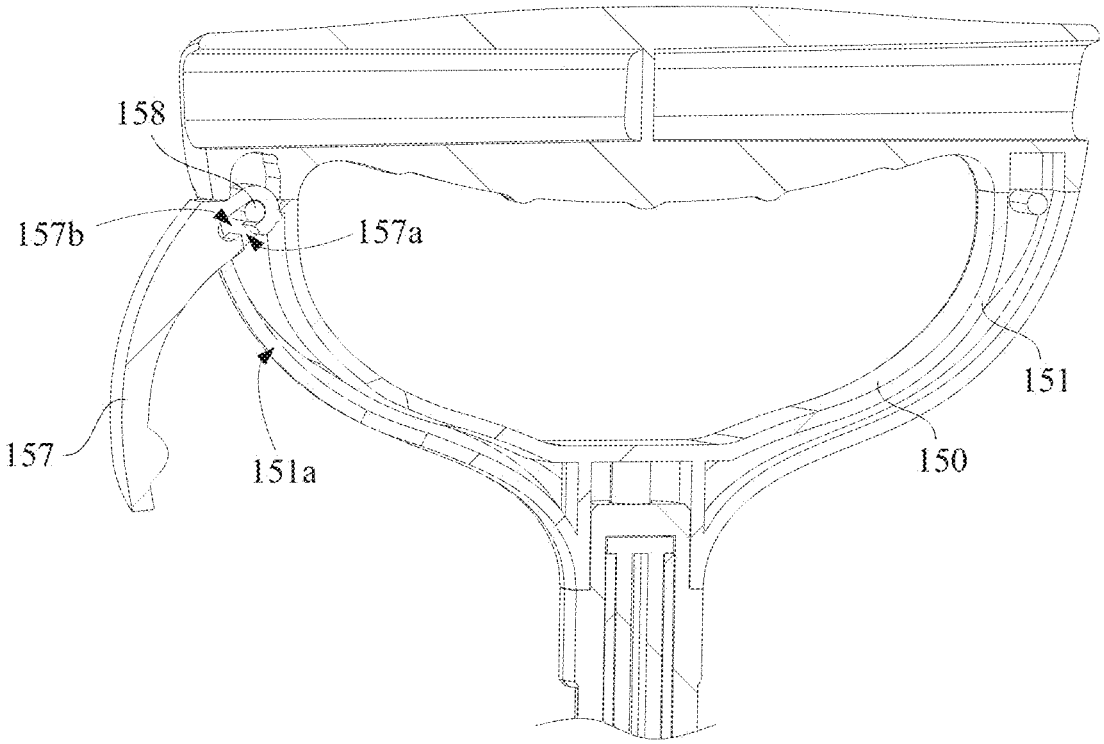
FIG. 21 is a sectional view of an opened state of a hook of a cane with a seat according to an embodiment.

Referring to FIG. 20 and FIG. 21, in some implementations, the handle 150 may further include a hook 157 connected to the gripping portion 151. An accommodating groove 151*a* is formed in the gripping portion 151. A rotating post 158 is provided at a bottom of the accommodating groove 151*a*. The rotating post 158 may be integrally molded with the gripping portion 151. An opening 157*a* penetrating into the rotating post 158 and a waist-shaped hole 157*b* communicating with the opening 157*a* are formed at one end of the hook 157. A width of the opening 157*a* may be less than a diameter of the rotating post 158. When the hook 157 and the gripping portion 151 are assembled, the hook 157 gets over the rotating post 158 through deformation of the opening 157*a* to limit the rotating post 158 in the waist-shaped hole 157*b* reliably. The hook 157 has a buckled state and an opened state relative to the gripping portion 151. In the buckled state, the hook 157 is buckled to the accommodating groove 151*a*, and the rotating post 158 abuts against one end of the waist-shaped hole 157*b*, as shown in FIG. 20. In the opened state, an end of the hook 157 away from the rotating post 158 is separated from the gripping portion 151, and forms a hanging space with the gripping portion 151, and the rotating post 158 abuts against another opposite end of the waist-shaped hole 157*b*, as shown in FIG. 21. Through cooperation between the waist-shaped hole 157*b* and the rotating post 158, the hook 157 in the opened state can be hung on the rotating post 158 through one end of a wall of the waist-shaped hole 157*b*. With the hook 157 and the gripping portion 151, the whole cane with a seat 10 can be reliably hung on the wall or other positions. When the hook 157 is switched from the opened state to the buckled state, a free end of the hook 157 is pushed by the user to the accommodating groove 151*a*. Meanwhile, an end of the hook 157 with the waist-shaped hole 157*b* moves away from the support base 110. In combination with cooperation between a buckling structure at the free end of the hook 157 and the accommodating groove 151*a*, the hook 157 can be buckled into the accommodating groove 151*a* stably, and the hook 157 is not separated from the accommodating groove 151*a* easily.

The technical features of the foregoing embodiments can be employed in arbitrary combinations. For brevity of description, not all possible combinations of the technical features of the foregoing embodiments are described. However, the combinations of the technical features should be construed as falling within the scope described in this specification as long as there is no contradiction in the combinations.

The above described are merely several embodiments of the present disclosure. Although these embodiments are described specifically and in detail, they should not be construed as a limitation to the patent scope of the present disclosure. It should be noted that those of ordinary skill in the art can further make several variations and improvements without departing from the concept of the present disclosure, and all of these fall within the protection scope of the present disclosure. Therefore, the protection scope of the present disclosure shall be subject to the protection scope defined by the claims.

What is claimed is:

1. A cane with a seat, comprising:

a support assembly comprising a support base, a slider, a main rod, and two auxiliary rods, wherein the main rod and the auxiliary rods penetrate through the support base and are rotatably connected to the support base; two opposite ends of each of the main and the auxiliary rods are stretched out of the support base; wherein the cane with a seat further comprises a handle connected to an end of the main rod away from the support base; the slider is in sliding fit with the main rod and is configured to drive the support assembly to switch between a collapsed state and an expanded state; in the collapsed state, the two auxiliary rods are collapsed to the main rod; and in the expanded state, the two auxiliary rods intersect at the support base to form an upper included-angle space and a lower included-angle space; the main rod penetrates through either of the upper included-angle space and the lower included-angle space; the two auxiliary rods are rotatably connected to each other, each forming an included angle with the main rod, and being symmetrically located at two opposite sides of the main rod;

a seat assembly comprising a main seat surface and two auxiliary seat surfaces, wherein the two auxiliary seat surfaces are rotatably connected to two opposite sides of the main seat surface in one-to-one correspondence; the main seat surface is rotatably connected to the slider; and when the support assembly is switched from the collapsed state to the expanded state, the slider drives the main seat surface to expand, the main seat surface drives the auxiliary seat surface to expand, and ends of the two auxiliary rods, which participate in forming the upper included-angle space and are close to the seat assembly, support the two auxiliary seat surfaces in one-to-one correspondence; and wherein the support assembly further comprises a first connecting rod and two second connecting rods; the first connecting rod comprises one end rotatably connected to the main rod, and another opposite end connected to the main seat surface; a junction between the first connecting rod and the main seat surface, and a junction between the main seat surface and the slider are spaced; ends of the two second connecting rods are rotatably connected to the slider; another opposite ends of the two second connecting rods are rotatably connected to the two auxiliary rods in one-to-one correspondence; each auxiliary rod is provided with a support end for supporting a corresponding auxiliary seat surface of the two auxiliary seat surfaces in the expanded state; a junction between each second connecting rod and a corresponding auxiliary rod of the two auxiliary rods is located between the support base and the support end; the junction between the slider and the main seat surface, a junction between the second connecting rods and the slider, a junction between the first connecting rod and the main rod, and the support base are arranged sequentially along an axial extension direction of the main rod.

2. The cane with a seat according to claim 1, wherein the two auxiliary rods each are an integrated structure.

3. The cane with a seat according to claim 1, wherein the support base comprises a main body and a cover plate that are detachably connected; the main body is provided with three through holes at intervals; and the main rod and the two auxiliary rods penetrate through the three through holes in one-to-one correspondence and are rotatably connected to the main body.

4. The cane with a seat according to claim 3, wherein the support base comprises a clamping ring; the cover plate and the main body enclose a groove extending along a circumferential direction of the main body; the main body is provided with a shaft hole at a bottom of the groove; the shaft hole is configured to penetrate through a rotating shaft to realize rotatable connection of the main rod and the auxiliary rod with the main body; and the clamping ring is limited at the groove and conceals the shaft hole and the rotating shaft.

5. The cane with a seat according to claim 4, wherein the cane with a seat further comprises an elastic member provided in the main rod; the elastic member comprises one end connected to the slider, and another opposite end connected to the main rod; and an amount of elastic deformation of the elastic member in the collapsed state is greater than an amount of elastic deformation of the elastic member in the expanded state, so as to drive the slider to slide along the main rod in the collapsed state, thereby switching to the expanded state.

6. The cane with a seat according to claim 5, wherein the cane with a seat further comprises a lock structure movably connected to the handle; in the collapsed state, the lock structure locks the slider at the main rod; and the lock structure is further capable of unlocking the slider, thereby switching to the expanded state.

7. The cane with a seat according to claim 6, wherein the lock structure comprises a button movably connected to the handle and a clamping member; the clamping member is provided with a clamping portion; a first clamping hole is formed in the main rod; a second clamping hole is formed in the slider; in the collapsed state, the first clamping hole and the second clamping hole communicate to penetrate through the clamping portion, such that the slider is locked at the main rod; and the button is configured for pressing, thereby driving the clamping portion to withdraw from the second clamping hole to unlock the slider.

8. The cane with a seat according to claim 7, wherein the lock structure comprises a restoration member abutting against the main rod and the clamping member; and after the second clamping hole moves from a misplaced state to an aligned state relative to the first clamping hole, the restoration member drives the clamping portion to penetrate into the second clamping hole.

9. The cane with a seat according to claim 4, wherein the handle comprises a gripping portion, an adjusting sleeve connected to the gripping portion, and an adjusting member detachably connected to the adjusting sleeve; the main rod penetrates through the adjusting sleeve and is provided with at least two first adjusting holes arranged at intervals along an axial direction of the main rod; a second adjusting hole is formed in the adjusting sleeve; the adjusting member penetrates through the second adjusting hole and one of the first adjusting holes, such that positions of the main rod and the handle are fixed relatively; and after the adjusting member is detached from the second adjusting hole, the gripping portion is capable of driving the adjusting sleeve to move relative to the main rod, such that the second adjusting hole is aligned to any one of remaining first adjusting holes, thereby penetrating through the adjusting member and adjusting the relative positions of the gripping portion and the main rod.

10. The cane with a seat according to claim 9, wherein the adjusting sleeve comprises an inner cartridge connected to the gripping portion, and an outer cartridge connected to the gripping portion and sleeved on the inner cartridge; the adjusting member is detachably connected to the outer cartridge and the inner cartridge; an end of the main rod close to the handle penetrates through a space between the inner cartridge and the outer cartridge; the outer cartridge is provided with the second adjusting hole; the inner cartridge is provided with an auxiliary hole aligned to the second adjusting hole; and the adjusting member penetrates through the auxiliary hole, the second adjusting hole and one of the first adjusting holes, such that the positions of the main rod and the handle are fixedly relatively.

11. The cane with a seat according to claim 9, wherein the handle comprises a hook connected to the gripping portion; an accommodating groove is formed in the gripping portion; a rotating post is provided at a bottom of the accommodating groove; an opening penetrating into the rotating post and a waist-shaped hole communicating with the opening are formed at one end of the hook; the hook has a buckled state and an opened state relative to the gripping portion; in the buckled state, the hook is buckled to the accommodating groove, and the rotating post abuts against one end of the waist-shaped hole; and in the opened state, an end of the hook away from the rotating post is separated from the gripping portion, and forms a hanging space with the gripping portion, and the rotating post abuts against another opposite end of the waist-shaped hole.

12. The cane with a seat according to claim 4, wherein the cane with a seat comprises an auxiliary assembly; the auxiliary assembly comprises a first swing arm and a second swing arm that are rotatably connected to the main seat surface; the slider is provided with a protrusion; the two auxiliary seat surfaces each are provided with an abutment portion; and when the support assembly is switched from the collapsed state to the expanded state, the protrusion presses the first swing arm and the second swing arm, and drives the first swing arm and the second swing arm to rotate relative to the main seat surface, the first swing arm presses the abutment portion at one side, and the second swing arm presses the abutment portion at the other side, such that the two auxiliary seat surfaces are expanded relative to the main seat surface.

13. The cane with a seat according to claim 12, wherein the auxiliary assembly comprises a return member connected to the main seat surface; the return member is connected to at least one of the first swing arm and the second swing arm; and when the support assembly is switched from the expanded state to the collapsed state, the return member drives the first swing arm and the second swing arm for restoration.

14. The cane with a seat according to claim 12, wherein the first swing arm comprises a body and a bearing portion that are molded integrally; the bearing portion is connected to one end of the body and is oblique to a length extension direction of the body; another opposite end of the body is provided with a guiding surface; the guiding surface is a plane and is oblique relative to a length direction of the body; the body is rotatably connected to the main seat surface; and when the support assembly is switched from the collapsed state to the expanded state, the protrusion presses the bearing portion and drives the body to rotate relative to the main seat surface, and the guiding surface presses the abutment portion corresponding to the first swing arm, so as to drive the corresponding auxiliary seat surface to rotate relative to the main seat surface.

15. The cane with a seat according to claim 14, wherein the first swing arm comprises a limiting portion integrally molded with the body; the limiting portion protrudes from the guiding surface along the length extension direction of the body; and when the protrusion presses the bearing portion, the protrusion limits a range of movement of the body.

16. The cane with a seat according to claim 4, wherein in a direction perpendicular to a length extension direction of the main rod, two opposite sides of the slider each are provided with a hanging hole; and the hanging hole is configured to connect a rope or hang an article.

17. The cane with a seat according to claim 4, wherein one of the two auxiliary seat surfaces is provided with a clamping block, and the other is provided with a clamping groove; and in the collapsed state, the clamping block is clamped into the clamping groove, and the ends of the collapsed auxiliary rods close to the seat assembly are accommodated in a space enclosed by the main seat surface and the auxiliary seat surfaces.

18. The cane with a seat according to claim 1, wherein the first connecting rod comprises a swing rod rotatably connected to the main seat surface, and a support rod rotatably connected to the swing rod; the support rod is rotatably connected to the main rod; the main seat surface is provided with a limiting groove for limiting a range of rotation of the swing rod; and when the support assembly is switched between the collapsed state and the expanded state, the swing rod drives the support rod to swing relative to the main seat surface.

* * * * *